US010273567B2

(12) United States Patent
Isaac

(10) Patent No.: US 10,273,567 B2
(45) Date of Patent: Apr. 30, 2019

(54) CENTRIFUGAL ATOMIZATION OF IRON-BASED ALLOYS

(71) Applicant: ROVALMA, S.A., Barcelona (ES)

(72) Inventor: Valls Anglés Isaac, Barcelona (ES)

(73) Assignee: ROVALMA, S.A., Barcelona (ES)

( * ) Notice: Subject to any disclaimer, the term of this patent is extended or adjusted under 35 U.S.C. 154(b) by 73 days.

(21) Appl. No.: 15/114,486

(22) PCT Filed: Jan. 27, 2015

(86) PCT No.: PCT/EP2015/051632
§ 371 (c)(1),
(2) Date: Jul. 27, 2016

(87) PCT Pub. No.: WO2015/110668
PCT Pub. Date: Jul. 30, 2015

(65) Prior Publication Data

US 2016/0348222 A1 Dec. 1, 2016

(30) Foreign Application Priority Data

Jan. 27, 2014 (EP) ..... 14382023

(51) Int. Cl.
*B22F 1/00* (2006.01)
*B22F 9/10* (2006.01)
(Continued)

(52) U.S. Cl.
CPC ..... *C22C 38/58* (2013.01); *B22F 1/0007* (2013.01); *B22F 9/10* (2013.01); *C22C 33/0285* (2013.01);
(Continued)

(58) Field of Classification Search
CPC ..... B22F 1/0007; B22F 9/10; B22F 2301/35; C22C 38/001; C22C 38/004; C22C 38/02–38/60
See application file for complete search history.

(56) References Cited

U.S. PATENT DOCUMENTS 2,305,172 A 12/1942 Landgraf
2,356,599 A 8/1944 Landgraf
(Continued)

FOREIGN PATENT DOCUMENTS

DE 899 893 12/1953
DE 100 64 056 A1 11/2001
(Continued)

OTHER PUBLICATIONS

Wright et al, "The Microstructure and PhaseRelationships in Rapidly Solidified TYpe 304 Stainless Steel POwders"< Metallurgical Transactions A, vol. 19A, Oct. 1988, pp. 2399-2405.*
(Continued)

*Primary Examiner* — C Melissa Koslow
(74) *Attorney, Agent, or Firm* — Ladas & Parry LLP

(57) ABSTRACT

A method for the production of iron-based alloy powders, or particulate materials, through rotating or centrifugal atomization (CA) is disclosed. The invention is suitable for obtaining steel powder, especially tool steel powder, high strength steels and other iron-based alloys of similar properties by means of centrifugal atomization, particularly conducted by means of a rotating element atomization technique. The fine, smooth, low oxygen content and low satellite, or even satellite-free, powder is atomized by a cooled rotating atomization device (e.g. disk, cup, . . . ) with various geometries in an atomization chamber under a preferably non-oxidizing atmosphere.

14 Claims, 4 Drawing Sheets

(51) Int. Cl.

| | |
|---|---|
| ***C22C 33/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/34*** | (2006.01) |
| ***C22C 38/36*** | (2006.01) |
| ***C22C 38/38*** | (2006.01) |
| ***C22C 38/42*** | (2006.01) |
| ***C22C 38/44*** | (2006.01) |
| ***C22C 38/58*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/34* (2013.01); *C22C 38/36* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *B22F 2301/35* (2013.01); *B22F 2998/10* (2013.01)

(56) References Cited

U.S. PATENT DOCUMENTS

| | | | | |
|---|---|---|---|---|
| 4,063,942 | A | 12/1977 | Lundgren | |
| 4,078,873 | A | 3/1978 | Holiday et al. | |
| 4,343,750 | A | 8/1982 | Holiday et al. | |
| 4,374,074 | A | 2/1983 | Ueda et al. | |
| 4,701,289 | A * | 10/1987 | Liles | B22F 9/10 264/8 |
| 4,731,517 | A | 3/1988 | Cheney | |
| 4,768,577 | A | 9/1988 | Flinn et al. | |
| 5,114,470 | A * | 5/1992 | Biancaniello | B22F 3/225 264/12 |

FOREIGN PATENT DOCUMENTS

| | | |
|---|---|---|
| EP | 2253727 | * 11/2010 |
| JP | 2-34706 A | 2/1990 |

OTHER PUBLICATIONS

Kato et al, "Effect of Atomization Conditions of Microstructure of Ni-base Superalloy Powder", Central Research Laboratory, Daido Steel Co., Ltd., 1985, pp. 719-726.*

Lawley, A, "Atomization—The Production of metal Powders", Metal Power Industries Federation, Mar. 1992, pp. 1-159.

Capus, J. M., Metal Powders—A Global Survey of Production, Applications and Markets to 2010, 4th Edition, 2005, pp. 1-220.

Zhao, Y.Y., "Analysis of flow development in centrifugal atomization: Part I. Film thickness of a fully spreading melt", Modelling Simul. Mater. Sci. Eng., vol. 12, 2004, pp. 959-971.

Xie, J.W., et al., "Effects of processing conditions on powder particle size and morphology in centrifugal atomisation of tin", Powder Metallurgy, vol. 47, No. 2, 2004, pp. 168-172.

Dunkley, J.J., et al., "Centrifugal Atomisation of Metal Powders", Advances in Powder Metallurgy & Particulate Materials, 2007, pp. 1-6.

Angers, R, "Centrifugal Atomization Influence of Process Parameters on Size Distribution", Advances in Powder Metallurgy & Particulate Materials, vol. 1, 1992, pp. 79-88.

Ozturk, S., et al., "Production of rapidly solidified metal powders by water cooled rotating disc atomization", Powder Metallurgy, vol. 44, No. 2, 2001, pp. 170-176.

Ozturk, S., et al., "Effect of production parameters on cooling rates of AA2014 alloy powders produced by water jet cooled, rotating disc atomization", Powder Metallurgy, vol. 46, No. 4, 2003, pp. 342-348.

Zhao, Y. Y., "Considerations in designing a centrifugal atomizer for metal powder production", Materials & Design, vol. 27, 2006, pp. 745-750.

Sungkhaphaitoon, P, et al., "Design and Development of a Centrifugal Atomizer for Producing Zinc Metal Powder", International Journal of Applied Physics and Mathematics, vol. 2, No. 2, Mar. 2012, pp. 77-82.

Labrecque, C., et al., "Inverted Disk Centrifugal Atomization of AZ91 Magnesium Alloy", Canadian Metallurgical Quarterly, vol. 36, No. 3, 1997, pp. 169-175.

Eslamian, M, et al., "Preparation of aluminum/silicon carbide metal matrix composites using centrifugal atomization", Powder Technology, vol. 184, 2008, pp. 11-20.

Plookphol, T., et al., "Influence of process parameters on SAC305 lead-free solder powder produced by centrifugal atomization", Powder Technology, vol. 214, 2011, pp. 506-512.

Shemyakina, O. A., et al., "Obtaining Solder Powders by Centrifugal Atomization of Melt", Russian Journal of Non-Ferrous Metals, vol. 51, No. 3, 2010, pp. 250-254.

Deng, H., et al., "Vibration of spinning discs and powder formation in centrifugal atomization", Proc. R. Soc. A, vol. 467, Jul. 21, 2010, pp. 361-380.

Li, H., et al., "Prediction of powder particle size during centrifugal atomization using a rotating disk", Science and Technology of Advanced Materials, vol. 8, 2007, pp. 264-270.

Angers, R., et al., "Inverted Disk Centrifugal Atomization of 2014", International Journal of Powder Metallurgy, vol. 30, No. 4, 1994, pp. 429-434.

Kear, B. H.,"On the Microstructure of Rapidly Solidified IN-100 Powders", Metallurgical Transactions A, vol. 10A, Feb. 1979, pp. 191-197.

Kim, K. H., et al., "Characterization of U-2 wt% Mo and U-10 wt% Mo alloy powders prepared by centrifugal atomization", Journal of Nuclear Materials, vol. 245, 1997, pp. 179-184.

Park, Jong-Man, et al., "Characterization of U—Nb—Zr dispersion fuel prepared by centrifugal atomization process", Journal of Nuclear Materials, vol. 265, 1998, pp. 38-43.

Ozturk, S., et al., "Effect of process parameters on production of metal powders by water jet cooled rotating disc atomization", Powder Metallurgy, vol. 48, No. 2, 2005, pp. 163-170.

Wright, R. N., et al., "The Microstructure and Phase Relationships in Rapidly Solidified Type 304 Stainless Steel Powders", Metallurgical Transactions A, vol. 19A, Oct. 1988, pp. 2399-2405.

Folio, F., et al., "Centrifugal atomisation of metallic alloys in inductive plasma onto cooled disc", Powder Metallurgy, vol. 43, No. 3, 2000, pp. 245-252.

Angers, R., et al., "Formation of irregular particles during centrifugal atomization of AZ9 1 alloy", Materials Letters, vol. 33, 1997, pp. 13-18.

Halada, K., et al., "Centrifugal Atomization of Iron-Rare Earth Alloys", Materials Transactions, vol. 31, No. 4, 1990, pp. 322-326.

(56) References Cited

OTHER PUBLICATIONS

Kato, T, et al., "Effect of Atomization Conditions on Microstructure of Ni-base Superalloy Powder", Central Research Laboratory, Daido Steel Co., Ltd., 1985, pp. 719-726.
ASM Handbook: vol. 7, 1998, pp. 25-51.

* cited by examiner

CENTRIFUGAL ATOMIZATION OF IRON-BASED ALLOYS

RELATED APPLICATION INFORMATION

This application is a 371 of International Application PCT/EP2015/051632 filed 27 Jan. 2015, which claims priority from EP Application No.: 14382023.1 filed 27 Jan. 2014, the content of which is incorporated herein by reference.

FIELD OF THE INVENTION

The present invention relates to a method for producing some high melting point alloy powders, or particulate materials, by means of centrifugal atomization; principally through the atomizing rotating element technique. The invention is designed for making rapidly solidified metallic powders.

BACKGROUND OF THE INVENTION

Atomization is the dominant method for producing metal and pre-alloyed powders from aluminum, iron, low-alloy steels, stainless steels, tool steels, titanium and superalloys, among others. Although there is a great diversity of methods, processes and techniques of atomization, particularly water and gas atomization have continued to dominate the production of high melting point metallic powders. Both techniques are relatively simple to implement but with lower energy efficiency, in addition to the well-known features of the produced powder; e.g. irregular shape, low surface quality, relative high internal porosity, relative wide particle size distributions (high geometric standard deviation $\sigma_g$, around 2.0-2.3), etc. On the other hand, other techniques, such as the centrifugal atomization (CA) exhibits, under certain process conditions, a higher energy efficiency with an outstanding powder quality. However, such type of processes are often technically more complex than the previous aforementioned techniques. The centrifugal melt atomization of metals is a liquid metal-fed physical method to produce powders, where a liquid stream of molten metal is poured onto a rotating disk or similar and it is broken and dispersed, under the action of centrifugal forces, into a fine powder particulate matters that subsequently solidify in contact with the atmosphere. The potential of centrifugal atomization techniques, especially for industrial applications, is not fully developed due to the lack of in-depth scientific understanding of the physical process of atomization and lack of reliable designs.

Traditionally, tool steel powders are produced by gas or water atomization methods. In general terms, water atomized tool steel powders exhibit irregular shaped particles and are suitable for die compaction and sintering to higher theoretical density. Although gas atomized tool steel powders exhibit spherical or near-spherical particles with high apparent densities, which thus may requires hot or cold isostatic pressing consolidation. The key factor of powder metallurgy of tool steels is based mainly on the uniform microstructure that can be obtained, compared to forged and conventionally produced products, and the higher homogeneity in its chemical composition. This situation, for example, leads to excellent values of toughness and less distortion during heat treatment, redounding in an increase of the tool service life.

Although, centrifugal atomization is conducted for producing a variety of metals and metallic alloys in commercial, near-commercial, laboratory and small pilot plant scales, surprisingly this technique has not been fully and broadly developed for mass production of iron-based alloys. CA is applied on an industrial scale for numerous singular applications, particularly for alloys presenting lower melting temperatures; thus the problems of erosion of the rotating element do not present a critical technical challenge. Ti, Ni, Fe and others . . . generic trough proper atomizing rotating element configuration, some concrete alloys with almost any atomizing rotating element configuration, but taking other parameters into account. However, and contrary to what has been observed and mentioned, the present inventors have found that, taking certain precautions, the centrifugal atomizing rotating element technique is suitable for the production of some steel powder, especially tool steel powder, high strength steels and other iron-based alloys of similar properties. Also, the inventors show that the atomization technique can be turned into the most economical; achieving the desired specifications of the iron-based powders and saving a large amount of energy and associated costs.

STATE OF THE ART

In the following paragraphs the state of the art of atomization and relevant aspects of it will be briefly revised, although excellent comprehensive literature reviews on the subject exist [Metal Powder Industry, ISBN-13: 978-187895415, 1992; Oxford University Press, ISBN-13: 978-0198562580, 1994; ASM International, ISBN-13: 978-0871703873, 1998; Metal Powder Industry, ISBN-13: 978-0976205715, 2005]. Melt atomization is the transformation of a bulk liquid into a spray of liquid droplets in a surrounding atmosphere. The bulk liquid is formed by melting a substance which is a solid at standard conditions of pressure and temperature and the end-product, after atomization stage and subsequent cooling, is a powder. Metal atomization is the most common method that allows the production of metallic powder over a wide range of compositions and particle sizes. While scientific literature may be found excellent reviews on powder metallurgy and atomization below some relevant aspect of the latter are described with special emphasis on the CA. Nowadays, ferrous and non-ferrous powders are mostly produced by water atomization and gas atomization whereas the centrifugal atomization technique remains as a secondary technique [Ed. Metal Powder Industry, ISBN-13: 978-1878954152, pp. 41-43, 1992; ASM International, ISBN-13: 978-0871703873, pp. 35-52, 1998; Elsevier Science, ISBN-13: 978-1856174794, p. 161, 2006]. Centrifugal melt atomization (also known as spinning disk, spinning cup or rotating atomization) is defined as the liquid metal-fed physical method to obtain powders where a liquid stream of molten metal is poured on a spinning disk (SDA) or similar and it is dispersed, under the action of centrifugal forces exerted by the rotating mean, into a spray of droplets, flakes or ribbons that subsequently solidify in contact with the atmosphere [ASM International, ISBN-13: 978-0871703873, pp. 35-52, 1998]. The principal markets for centrifugal atomized metals present several well established and high value applications such as electronic solder pastes, zinc for alkaline batteries, titanium and steel shot and some thermal spray and magnetic powders [Proc. of Int. Conf. on Spray Deposition and Melt Forming, Bremen Universität, pp. 1-6, 2006].

In general, centrifugal atomization methods are much more energy efficient than gas and water atomization and also generally leads to a much narrower particle size distribution than does the former technique [ASM International, ISBN-13: 978-0871703873, pp. 35-52, 1998]. Centrifugally atomized powder, obtained in an inert or vacuum atmosphere, are normally spherical or nearly-spherical and have smooth surfaces with very good production yield rates at low operating costs for some alloys when proper process parameters used. For some alloys it is previous to this invention considered not possible to use the technology at an industrially acceptable level.

However, when the centrifugal atomization technique is applied to higher melting point metals it is difficult to operate at the highest rotation speeds, because of the need to increase the diameter of the atomization chamber. Also, the premature solidification of liquid (skull) on the rotating element and the problems of out-of-balance forces, erosion, thermal fatigue and compatibility of materials result in heavy maintenance costs of the spinning disk assembly. The rapid solidification rate process (RSR), developed by Pratt & Whitney—United Technologies (U.S. Pat. No. 4,078,873 A and U.S. Pat. No. 4,343,750 A) for making superalloy powders, is one of the most recognized technique of centrifugal atomization. In order to overcome the handling issues of high melting point and aggressive alloys, the process employs a high-speed water-cooled rotating disk combined with high-pressure helium gas to increase the solidification rates. The largest RSR facilities can handle batches up to 900 kg with a spray chamber of about 5 m in diameter and a closed-loop helium recirculation system. The production rate reaches up to 1100 $kg \cdot h^{-1}$ for Ni-based superalloys. In this case, also the use of high volumes of helium is another drawback. As a result of these disadvantages, water and gas atomization have continued to dominate the production of high melting point metallic powders. U.S. Pat. No. 4,374,074 (A) divulged a process for producing spherical particles or fibers with a specially fixed size from a melt of metal, slag, or flux, using a rotating disk in order to: form a thin film stream of boundary layer on the disk; project the thin film stream at a high speed from the disk periphery into surrounding space to split up the film stream into linear streams; and cool the linear streams for producing fibers or cooling droplets after further splitting of the each linear stream into droplets for producing spherical particles, with or without parallel or countercurrent gas flow to the linear streams. The rotating atomizing element is composed by a flat disk block, having a flat refractory surface, made of different refractory materials supported by a metallic holder, made of heat-resisting steel. The inventors cite that the best conditions, in order to produce spherical particles, are obtained forming additional jet streams of gas with the directions opposite to those of the free linear streams of the melt projected from the rotating disk periphery, at a room or lower temperature and at an atmospheric or higher pressure. According to inventors, the rotational speed of the rotating disk is preferably adjusted between 3,000 and 30,000 rpm and the effective diameter of the rotating disk, to be used in the process disclosed in the invention, is preferably located in the range of 50 to 200 mm.

A number of production processes have been proposed for producing spherical, nearly-spherical and other non-spherical typical appearances of metal particles (acicular, fibrous, flakes, hollow, dendritic, irregular, aggregates, spongiform, etc.) by pouring a melt onto the surface of a rotating element. Regarding the production of non-spherical particles, U.S. Pat. No. 4,063,942 (A) relates to a new metal product, namely a metal flake product suited for the production of metal powder for powder metallurgical purposes, and it also describes a process for manufacturing the metal flake product. According to the invention, this new product is a metal flake product consisting of a plurality of relatively thin, brittle and easily crushed, substantially dendrite-free metal flakes of amorphous to compact-grained structure. Particles are produced by causing molten steel to form at least one discrete, relatively thin flake-shaped layer on a relatively cold metal surface of great cooling capacity (flat disk, cup), moving rapidly and substantially across the direction of delivery of the molten steel. Due to the great cooling capacity the layer is made to solidify extremely rapidly (expediently at least about $10^{-6}$ $C \cdot s^{-1}$). According to the inventors in order to facilitate the subsequently breaking up of the metal flakes into powder of the required particle size, the manufacturing parameters which determine the dimensions of the flakes be so mutually adjusted. Accordingly, the thickness of the flakes is at the most about 0.50 mm and preferably at most about 0.10 mm. Additionally, the parameters are also mutually adjusted so that the length/thickness ratio of the flakes is at least 100, the width/thickness ratio of the flakes is at least about 20, and the length/width ratio of the flakes is at most about 5. Another example of flaky powder production process was disclosed in JP Patent No. H02 34,706 (A), which relates to a process to manufacture flaky powder at high yield by flowing molten material of glass, metal (stainless steel, Ag, Al, Cu, Ni and Zn), etc., through atomizing gas and colliding formed drops before solidifying against cone type or horn type rotating cooling element. Interestingly, in this case a conical rotating element which is less common than the rotating cup-shaped elements is used, however this shares the same basic characteristics in terms of which the surface in contact with the material to be processed is smooth without any protrusions or protuberances. The present patent is addressed to obtain spherical or nearly-spherical metallic particles, which is a totally different production technology with other difficulties to overcome. Additionally in both cases the rotation axis of the rotating element and the axis of the molten metal stream casting are displaced in parallel, producing that either the stream of molten metal and/or the gas atomized stream impinge eccentrically upon the rotating cooled element.

The development and production of metallic powder, particularly through atomization, is a field that grows in a continued and sustained way. It has become broadly recognized as a very superior way of producing raw material, in the form of powder with specific properties, for broadly evolved applications in the called powder metallurgy (PM) or particulate materials technologies; e.g., additive or layer manufacturing (rapid manufacturing/prototyping, 3D printing, laser forming, among others), thermal spray, welding, metal injection molding (MIM), powder forging, extrusion, Hot Isostatic Pressing (HIP), etc. The consolidation of some alloyed metallic powders, via HIP (high pressure and high temperature) or equivalent technologies, can produce high quality and high-performance parts with a fine-grained microstructure without inclusions and segregation, achieving high apparent density or even full density.

Furthermore, and from a technical standpoint, the centrifugal atomization technique is not progressing as quickly as expected as a consequence of the high cost of the produced powder and it is possible that the partial success of this kind of technique, applied to the high melting point materials, is due to technical and economic difficulties related to the quality and properties of the obtained powders; such as morphology, surface quality, microstructure (at different levels; e.g. nano and femto), small production volumes, productivity ratios (yield), costs, etc.

Atomization of melts has many applications and advantages for metal powder production and the main difficulty in the development of the technics was the lack of appropriate materials and methods for handling molten metals. At the same time, some of the most attractive benefits are the high degree of flexibility in alloying, the control of impurities and the homogeneity of the chemical composition provoking that pre-alloyed powders can only be produced by this mean. Several atomization techniques have been developed for producing metallic powder and pre-alloyed powder from ferrous and non-ferrous alloys. Some of these techniques have been extensively developed and applied to large scale production (more than 95% of atomization capacity worldwide), including two-fluid atomization, e.g. gas atomization, water atomization and oil atomization, vacuum atomization and rotating electrode atomization. Although other techniques have been assessed at laboratory and pilot plant scales and may be considered as near-commercial techniques, such as rotating disk atomization, among others.

In two-fluid atomization the stream of molten metal flowing from a nozzle is broken by the action of one or several jets of fluid (e.g. water, gas) directed downwards at certain angle. As a consequence of the momentum transfer, from the atomizing gas to the molten melt, a fine dispersion of metallic droplets is produced. The fluid jets breaks the metal stream into droplets that are immediately quenched and fall to the bottom of the atomization vessel. For water atomization, the metal powder/water slurry is removed for filtering, drying and, in some cases, annealing in a reducing atmosphere. Water atomization is the main method of atomization of ferrous metal powders and metals that have easily-reducible oxides. The largest commercial application of water atomization involve iron powder production, although also is applied to the commercial production of copper, copper alloys, nickel, nickel alloys, tool steels, stainless steels and precious metals powders. Generally, water atomization is less expensive than other atomization techniques because of the reduced cost of the atomizing medium (water), the low energy consumed for its pressurization and the high intrinsic productivity of the method. The primary limitations of this technique are the irregular-shaped particles with a broad droplet size log-normal distribution (geometric standard deviation from 1.8 to 3.0), the powder purity and, for reactive metals, the high oxygen content. Frequently, the formation of an oxide film, covering the surface of the droplets, and the presence of refractory oxides prevent the spheroidization of the aforementioned droplets. Cooling rates for water atomization are one to two orders of magnitude larger than for gas atomization (N or Ar) [ASM International, ISBN-13: 978-0871703873, pp. 35-52, 1998].

Inert gas atomization (IGA) is the most extended way to effectively produce particulate metals and alloys with a high tendency to oxidize, or alloys that have components whose oxides are hard to reduce. Gas atomization of melt involves the interaction of the melt and an atomizing gas (Ar, N, He, air) and it is applied for the commercial production of powders of aluminum, aluminum alloys, copper and its alloys, magnesium, zinc, titanium, titanium alloys, nickel-based alloys, cobalt-based alloys, tin, lead, etc. This technique operate with cooling rates in the range of 1E+02 to 1E+05° $C.\cdot s^{-1}$ and with a low energy efficiency. In general, inert gas-atomized powders exhibit a log-normal size distribution, with a geometric standard deviation close to 2.0. In this case, the mean particle size is controlled by the gas-metal flow ratio whereas for water atomization, the mean particle size is controlled by the pressure (velocity) of the water jets. The surface of gas atomized powders is generally smooth with a cellular or dendritic microstructure, however large variations of smoothness and sphericity are common in practice, mainly for aluminum-based alloys, copper and zinc alloys. Other drawback, associated with gas atomization, is the entrapment of small amounts of atomizing inert gas within the particles, which can cause porosity; especially in the case of argon and for coarse particles. Nevertheless, there are some applications of atomization where this effect is sought. For example, The U.S. Pat. No. 4,768,577 (A) states a method and metal powder produced thereby in which beneficial levels of entrapped gas (concentration) are introduced in metal under specific parameters of the atomization process. Briefly can be established that the U.S. Pat. No. 4,768,577 (A) discloses, as a general object of the invention, a method for alloying inert gases in metal. It is a more particular object of this invention in one form to provide a method for producing a preselected level of He in type 304 stainless steel. It is also a general object to provide a method for making metals and atomized metal powders with beneficial levels of entrapped inert gas. Moreover, it is another general object to provide a method for making metals with beneficial levels of entrapped inert gas. In the referred system for producing atomized metal powder, the stream of the molten metal to be atomized is delivered onto a rotating smooth, cup-shaped rotating element. The gas delivery means is comprised by a manifold to provide a stream of quench gas (e.g. He) for rapidly cooling the atomized powder. The method provided seems reasonable for type 304 stainless steels. This document provides little insight in the process parameters employed. There are no indices that the rotating element employed for atomization is of ceramic nature. It describes the obtained powders as possessing great fineness without providing size values. No indices of high degree of sphericity are available.

Finally it should be noted that centrifugal or rotating atomization methods are by far more energy efficient than water or gas atomization and also leads to a much narrower particle size distribution with a geometric standard deviation ranging between 1.2 and 1.4. This technique can operate at high cooling rates, up to 1E+05° $C.\cdot s^{-1}$, for the production of solder powder for electronic applications, zinc, aluminum, aluminum alloys, magnesium, nickel-based superalloys and even reactive and refractories metals, such as molybdenum and titanium. In a simple model, droplet formation involves a force balance between the acceleration force, due to rotation, and liquid surface tension force. Accordingly, it is well established that the mean diameter of centrifugal atomized particles ($d_{50}$) is predominantly controlled by the angular velocity, the diameter of the rotating element, the metal surface tension/density ratio, the molten metal feed rate and viscosity; in decreasing order of importance.

Notwithstanding the above-mentioned advantages, centrifugal atomization and especially centrifugal disk atomization, is not extensively used on an industrial scale for powder production due to some technical limitations. Several researchers claims that the realization of the full potential of centrifugal atomization for industrial applications is also prohibited by the lack of in-depth scientific understanding of the process and reliable designs [Modelling Simul. Mater. Sci. Eng. Vol. 12, pp. 959-971, 2004, Powder Metall., Vol. 47, pp. 168-172, 2004; Proc. of Int. Conf. on Spray Deposition and Melt Forming, Bremen Universität, pp. 1-6, 2006]. Regarding this, many researchers have put much effort in development and understanding of the phenomena involved in a process of atomization [Advances in Powder Metallurgy & Particulate Materials, Vol. 1, pp. 79-88, 1992; Powder Metall., Vol. 44, pp. 171-176, 2001; Powder Metall., Vol. 46, pp. 342-348, 2003; Powder Metall., Vol. 47, pp.

168-172, 2004; Mater. Design, Vol. 27, pp. 745-750, 2006; Sci. Technol. Adv. Mat., Vol. 8, pp. 264-270, 2007; Proc. R. Soc. A, Vol. 467, pp. 361-380, 2011]. Additionally, this situation is even magnified when the application of this technique is addressed to high melting temperature materials.

In the past decades, centrifugal atomization has been developed for manufacturing powders from a variety of metallic materials and alloys, including Al, Co, Cu, Mg, Ni, Pb, Sn, Ti, Zn, and their alloys. In the following paragraphs a few examples, reported in scientific literature and related principally to laboratory or pilot plant scale applications, are cited.

Some authors investigate the effects of atomizer design and processing parameters on the morphology and size distribution of centrifugally atomized pure tin, pure lead, zinc, aluminum and an aluminum alloy powders [Powder Metall., Vol. 44, pp. 171-176, 2001; Powder Metall., Vol. 46, pp. 342-348, 2003; Powder Metall., Vol. 47, pp. 168-172, 2004; Powder Metall., Vol. 48, pp. 163-170, 2005]. Some other authors use the centrifugal atomization technique to obtain solder powders, e.g. Sn—Pb and Sn—Cu [Russian J. of Non-Ferrous Metals, Vol. 51, pp. 250-254, 2010] and lead-free solder powder [Powder Technol., Vol. 214, pp. 506-512, 2011]. Sungkhaphaitoon [Int. J. of Appl. Phy. and Math., Vol. 2, No. 2, March 2012] investigated the influence of the operational conditions on the mean particle size, particle size distribution, production yield, and morphology of the centrifugally atomized zinc powder. Angers et al. [Advances in Powder Metall. & Particulate Mater., Vol. 1, pp. 79-88, 1992; Int. J. of Powder Metall., Vol. 30, pp. 429-434, 1994, Mater. Lett., Vol. 33, pp. 13-18, 1997] and Labreque et al. [Can. Metall. Q., Vol. 3, pp. 169-175, 1997] use an inverted disk configuration to study the centrifugal atomization of aluminum and magnesium alloy respectively. Similarly, Sheikhaliev et al. [Metal Powder Report, Vol. 63, pp. 28-30, 2008] studied the influence of oxygen content on the shape and particle size distribution of aluminum powder particles. Additionally, an excellent perspective of the production of non-ferrous metal powders and their alloys is provided in the book edited by Neikov et al. [Elsevier Science, ISBN-13: 978-1856174220, 2005].

The use of RSR method has allowed to produce, analyze and characterize the microstructure and phase relationships of rapidly solidified metallic powder of nickel-based superalloy (e.g. IN100), iron-based superalloy (e.g. JBK-75), steels, aluminum alloys, 304 stainless steels and minor quantities of reactive metals such as titanium and molybdenum, among others [Metall. Trans. A, Vol. 10, pp. 191-197, 1979; Metall. Trans. A, Vol. 13, pp. 1535-1546, 1982; Metall. Trans. A, Vol. 19, pp. 2399-2405, 1988].

Katoh et al. [Tetsu-to-Hagané/J. Iron Steel Inst. Jpn., Vol. 71, pp. 719-726, 1985; Mater. Trans., JIM, Vol. 31, pp. 363-374, 1990] developed a liquefied helium cooling centrifugal atomization technique to producing Ni base superalloy powders. Meanwhile, Folio and Lacour [Powder Metall., Vol. 43, pp. 245-252, 2000] describe a centrifugal atomization process, associated with inductive plasma technology, for the production of metallic powder such as Ni base superalloy, Ti alloy and pure Cu. For example, the invention disclosed in the U.S. Pat. No. 4,731,517 (A) relates to atomization techniques for producing ceramic powders and metal powders with extremely fine particle size, high density and optimum and grain structure. Accordingly, one of the principal object of the invention is to combine plasma torch melting with impact atomization and rapid chilling steps to achieve highly desired very fine particle powders of metals or ceramics, with particles size ranges falling between 0.10 to 25 microns. The apparatus described in the U.S. Pat. No. 4,731,517 (A) include the use of an endless belt and a rotating flat metal or ceramic disk (horizontal or vertical plane position), having accessories such as a revolving brush and a wipe sponge, as a elements of atomization. Regarding the metal powder production using the revolving disk, it can be seen, as shown by the examples which it has been applied using a 316 L stainless steel and an agglomerated Mo powder, delivered to the relatively low rate of roughly 4.5 $kg \cdot h^{-1}$ (10 $kg \cdot h^{-1}$) to the plasma gun. Centrifugal atomization technique has also been used to make reinforced metal matrix composites. Eslamian et al. [Powder Technol., Vol. 184, pp. 11-20, 2008] describe, at a laboratory scale, the development of a technique to produce metallic matrix composites by injecting silicon carbide particles into molten aluminum alloy just prior to centrifugal atomization. Even iron-rare earth, Nd, Gd or Tb alloy powders, with eutectic compositions, were centrifugally atomized by Halada et al. [Mater. Trans., JIM, Vol. 31, pp. 322-326, 1990]. Kim et al. [J. of Nuclear Mater., Vol. 245, pp. 179-184, 1997] reported a centrifugal atomization process to obtaining U—Si and U—Mo reactor fuel alloys. In the same line of research, Park et al. [J. of Nuclear Mater., Vol. 265, pp. 38-43, 1999] characterize a U—Nb—Zr dispersion fuel alloy prepared by centrifugal disk atomization process. German Pat. No. DE 10064056 (A1) discloses a method for the preparation of a sintered body of a high-chromium cast iron having greatly improved mechanical, as compared with conventional cast bodies of the same cast iron. The method comprises, among other things, a step of preparing a powder of the cast iron alloy by quenching solidification of a melt, e.g., by centrifugal spray atomization. This quenching solidification treatment of the melt is conducted preferably by the centrifugal spray atomization method, in which the melt is ejected at a quenching disk rotating at a high velocity to be atomized by the centrifugal force into fine droplets, which are quenched by blowing of an inert gas to be solidified to give fine particles. Despite the fact that the document highlights some advantages of the centrifugal atomization processes and some cooling rate values are described, in the said document, for example, the applied molten metal flow rate, the operating conditions of rotation, the dimensions of the rotating element, among others, are not reported. As is clear (column 3, lines 11-15) the material to be treated is a cast iron, with high chromium content, while herein the treated materials are mainly steels, special steels and tool steels. Furthermore in DE 10064056 (A1) the centrifugal spray atomization is conducted utilizing a flat rotating element or a flat rotating disk, similar to the previously published and established in German Pat. No. 899893 for iron alloys presenting 3 to 4% of carbon.

While the centrifugal atomization is a largely recognized method to obtain low melting point metallic powder, is easy to verify that it is remains as a secondary method for the powder production of high melting point metals and alloys, such as low alloy steels, nickel and titanium alloys. Virtually all of the gross volume production of tool steel powders is conducted through water or gas atomization methods with high standards of powder cleanliness. While the former have irregularly shaped particles and are suitable for conventional die compaction and sintering to high or theoretical density, the gas atomized tool steel powders exhibit a spherical particle shape and are usually consolidated to full density by HIP, MIM, or extrusion. Therefore, it is possible to notice that powders obtained by different methods both differ in particle shape and chemical composition and, occasionally, require different consolidation techniques.

The change from one technique to another technique of atomization not only causes an evident change in morphology, surface quality, particle size distribution, and even composition of the obtained powder, also promotes a noticeable and marked difference in the powder microstructural characteristics. It is well established that microstructural features in atomized powders are controlled by the relationship between the solidification rate, the thermal gradient and the cooling rate, also influenced by the operating conditions of the process and the physical properties of the metal to atomize. The formation of the resulting microstructure (planar, cellular, dendritic or dendritic-like microstructures) strongly depends on the combination of these variables.

As shown above, centrifugal atomization is conducted for producing a variety of metals and metallic alloys in commercial, near-commercial, and laboratory and small pilot plant scales. Even it can be seen that the technique has been applied to high melting temperature or higher melting point alloys, to produce powder in amounts that are easier to handle and atomize.

Although centrifugal atomization of high melting temperature metallic alloys, e.g. iron-based and nickel-based alloys, has already been implemented at near-commercial production, it is possible to say that the application of this technique to a larger scale (industrial scale) for the production of iron-based powder alloys and tool steel powders, with an adequate size for P/M applications, is not a trivial and a simple task; being entirely different and with novel challenges to overcome. This requires of appropriate designs to handle larger molten metal feed rates, enough to convert the technique an attractive solution, resolve technical problems associated with the rotating element (disk) and materials, erosion caused by the molten metal, cooling, etc.

However, and contrary to what has been observed and mentioned, the present inventors have found that, taking certain precautions, the centrifugal disk atomization technique is suitable for some iron-based powder production and also can be turned into the most economical; achieving the desired specifications of the steel powders and saving a large amount of energy.

SUMMARY OF THE INVENTION

The main purpose of the present invention is the production of economic spherical or nearly-spherical metallic powder by means of centrifugal atomization.

Thus the present invention provides a method for producing iron-based alloy powders or particulate material, comprising the steps of:

a) providing an alloy composition with a melting point above 1040° C.,
b) melting the composition, and
c) atomizing the molten composition by means of centrifugal atomization or rotating atomization.

DETAILED DESCRIPTION OF THE INVENTION

Figure 1:
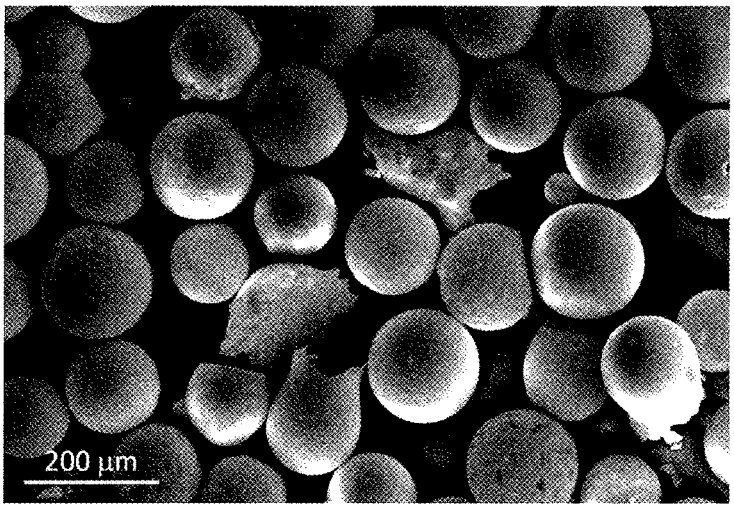
FIG. 1: Atomized steel powder particles.

According to the present invention a method is set forth wherein steel powder, especially tool steel powder and some other iron-based alloys of similar properties, is produced by means of centrifugal atomization; particularly through the spinning/rotating atomization technique.

In one possible interpretation of the present invention it can be implemented in the following way. Fabrication of two distinct and separated chambers or vessels: (i) the melting vessel and the (ii) atomization vessel, situated in a lower physical position. Obviously there are many other configurations and this is one in particular of the many examples that may be.

Regarding to the melting vessel, this is composed of a vacuum induction furnace (VIM, vacuum induction melting), an ancillary tundish and equipment, specially designed and mounted on a suitable frame structure which allows the system to operate under different configurations. The atomization chamber is built of stainless steel sheet and mounted on a support structure provided with auxiliary equipment for monitoring temperatures, measurement of the oxygen content, vacuum level, observation view ports for monitoring and filming the atomization process using a high speed camera, etc. The atomization chamber have a cylindrical upper part, whereas the bottom part have an inverted conical shape. Both chambers allow operate in vacuum conditions, at different levels, and even under inert gas atmospheres, such as Ar, N, He, a gas mixture or similar.

The atomizing rotating element, assembled on a vertical rotating axis arrangement, is located in the atomization vessel, just a few millimeters below of the specially designed tundish nozzle. The drive shaft of the atomizer element can be mounted for rotation by any means desired and is driven by an electric motor with rotating speeds below to 40,000 rpm, preferably below to 33,000 rpm, more preferably below to 22,000 rpm or even more preferably below to 15,000 rpm. Nevertheless for some special applications of the obtained particulate material it is preferable to have a minimum rotating speed of 25,000 rpm, preferably above to 30,000 rpm, more preferably above to 45,000 rpm or even more preferably above to 60,000 rpm. While an electric motor has been referred, any known driving means can be used; such as an air turbine or any rotating device and even a higher speed rotation can be used (up to 100,000 rpm or more and even up to 200,000 rpm). The atomizing rotating element, simultaneously with the electric motor, can be placed and adjusted at different coordinates using a servo motorized multi-axes system mounted on a metallic structure of support. The atomizer element (e.g. disk, cup, . . . ), constructed with diverse materials (high mechanical strength and different thermal conductivities), diameters and geometries, can also incorporate a single or multiple-layer top-coated surface and a high cooling system specially designed, however these are not subject to excessive detail herein.

Figure 2:
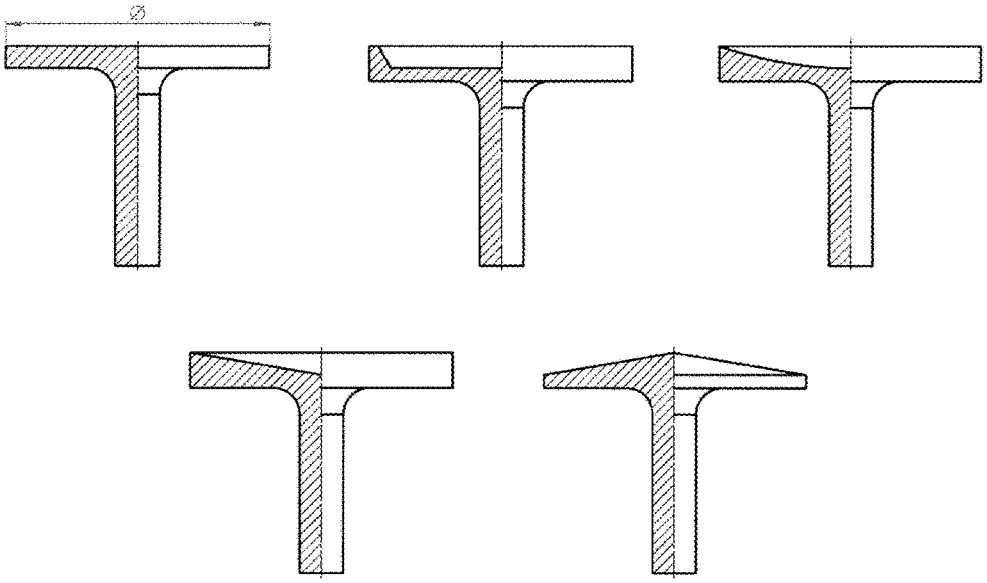
FIG. 2: Cross-sectional area of the most reported atomizing disks.

The inventors of the present invention have noted that one of the crucial aspects for the proper development and operation of the present invention is the design of the rotating element (e.g. disk, cup . . . ). The atomizing rotating element is defined as the element responsible for carrying out the operation or the physical mechanism of atomization of the liquid metal. It is useful to mention that although in several occasions the inventors refer to the atomizing rotating element as rotating or spinning disk atomizer, the use of any other atomizing rotating element geometry is also included; for example a flat disk, cup, cone, inverted cone or any other suitable geometries and even the use of a certain number of vanes or fins is also contemplated. It is also possible define these vanes as protrusions onto the surface of the rotating element with a certain cross-sectional area and a given single or multiple extrusion path which eventually form channels through which flows the liquid metal. Such protrusions from the rotating element may include a radial component, for example having a profile evolution in the direction normal to the active surface of the rotating element at the line of insertion. The the rotating element may also present protuberances with a profile evolution in the direction normal to the active surface of the rotating element at the line of insertion or with a variable curvature in the direction normal to the active surface of the rotating element at the line of insertion. In fact for difficult to atomize alloys vanes or other protuberances (in the way defined in this document) and their design are a critical aspect of the present invention since they will provide amongst others with the necessary drag independently of the wetting angle between disk material at the active surface and molten metal. The profile of the vanes may but need not be contained in one single plane. FIG. 2 shows several cross-section areas of the most utilized and reported atomizing disks such as a flat disk, cup-shaped disks, and conical disk, among others. FIGS. 3 to 6 show several atomizing rotating elements according to the present invention. It can be observed that this elements can be utilized using a lid and a central element that can be fabricated with other material according to the invention.

In one embodiment, the rotating element presents protuberances with a profile evolution in the direction normal to the active surface of the rotating element at the line of insertion.

In another embodiment, the rotating element presents protuberances with a variable curvature in the direction normal to the active surface of the rotating element at the line of insertion.

In yet another embodiment, the rotating element presents protuberances with a variable curvature in the direction parallel to the active surface of the rotating element at the line of insertion.

In a further embodiment, the protuberances form vanes on the surface of the atomizing rotating element, wherein the vanes have a profile that is contained in a single plane.

The atomization of alloys with different chemical compositions and different optimized processing parameters promotes that the present invention require different disk configurations. Despite the high amount of energy that receive the disk, the inventors have surprisingly found that it is possible to operate, with some of the compositions of the present invention (despite its high melting temperature) under a relative cold disk condition and thus prevent deterioration and erosion. Concerning this, the inventors have found that it is necessary to have a metallic disk, which does not react with the molten metal, with high mechanical properties, preferably high thermal conductivity and high melting temperature. Is important to note that the mechanical properties required by the disk are extremely high due to the centrifugal forces exerted during rotation in addition to the thermal stresses promoted by the molten metal.

Regarding to design and construction of the rotating disk any alloy or material with a desired melting point higher than 1,200° C. or more, preferably above 1400° C. and more preferably above 2,200° C. or more and with a desired high thermal conductivity greater than 36 $W \cdot m^{-1} \cdot K^{-1}$, preferably above 52 $W \cdot m^{-1} \cdot K^{-1}$, more preferably above 68 $W \cdot m^{-1} \cdot K^{-1}$ and even preferably above to 82 $W \cdot m^{-1} \cdot K^{-1}$ or more and with a desired high mechanical strength higher than 460 MPa, preferably above 680 MPa, more preferably above 820 MPa or even above to 1,200 MPa or more, can be used. The rotating disk must be well cooled which can be achieved through the application of a spray of gas or even water. In addition, it is necessary that the disk has a water-mist-tight constructive design.

The inventors have seen that for some applications of the compositions of the present invention it is advisable to cover the disk with a thin layer of ceramic material coat (e.g. single layer, multiple-layer . . . ). For some special applications of the alloy compositions of the present invention the best disk configuration takes place with a ceramic disk of high thermal conductivity (e.g. AlN, BN . . . ). The disk must be manufactured in order that it can resist the mechanical stresses and it should be refrigerated, though often not as severely as in the previous configurations, and surprisingly the inventors have found that the disk is not broken by thermal shock.

For all previous configurations the inventors have seen, especially when not excessive cooling is required, that can be advantageous to use a holder-disk accessory with high mechanical properties and low thermal conductivity which acts as thermal insulation, in order to avoid that the heat generated by the mass of the molten metal affects the driving-disk system. This accessory must be constructed with materials that exhibit high mechanical properties and low thermal conductivity such as the fully stabilized zirconia (FSZ) or partially stabilized zirconia (PSZ) or even high strength alumina or many others. For materials with a low thermal conductivity high alloyed steels, titanium alloys or many others can be used. For some applications of the compositions of the present invention, and when wettability (defined as the ability of a liquid to maintain contact with a solid surface) is not as critical parameter, the inventors have found that it is interesting to use a disk of high mechanical properties and low thermal conductivity, as in the case of the holder-disk accessory, however in this case the disk is not cooled or very little cooled.

For all configurations the inventors have found that it is advantageous to cover the rotating element with a layer of a material coat similar or related to the melted material or even a material that can cause the same positive effect on the slippage of the molten metal onto the rotating disk. Depending on the metal to be atomized, the rotating element can be coated with a stable compound of it. The coating compound is selected on the basis of its melting temperature and the grade of reactiveness between the material of the rotating element and the molten metal at high temperature (pouring). During atomization, the liquid metal is poured onto the coated rotating disk and, depending on the atomization conditions, it can couples with the coating and can forms a stable skull (normally doughnut-shaped and defined as a premature solidified layer on the surface of the atomizer), which improve wettability.

The ceramic materials mentioned and described above can be used under several configurations, for example the use of ceramic materials in only one particular area of the rotating disk, such as in the center since it is the greatest area of thermal erosion.

Particularly, the inventors of the present invention also have noted that an additional key factor, for the proper development and operation of the present invention, is the accurate design of the rotating element geometry in order to improve the grade of slippage. As been mentioned, and according to the application, the characteristics of the atomized powder may be improved mainly increasing the rotational speed of the rotating element, among others. The slippage between the liquid and the rotating element (i.e. the relative velocity difference) is an issue mostly associated with flat rotating atomizers and is the main disadvantage, particularly at high rotational speeds. One direct consequence of slippage is that it can promote an ejection velocity of the molten metal, from the disk periphery, lower than the peripheral velocity of the rotating element. Minimize the grade of slippage can include the use of a rotating element provided of a number of vanes or fins (e.g. straight, curved . . . ), channels, guides and other flow control devices allowing the liquid guidance to the periphery. The geometry of the vanes can present single or double curvature and its geometrical layout can be radial or any other suitable to the purpose of atomization. The vaned atomizers reduce slippage and increase the velocity of the metal flow, though viscous friction, improving to the atomization performance and its uniformity. It has been observed that the degree of slippage depends on the atomizer geometry, rotation speed, the mass flow rate of the molten metal and the surface wettability between the molten metal and the atomizer element. Regarding the above mentioned, it is very interesting that the rotating element can cause more mechanical drag or slippage over the mass of liquid metal and it is therefore necessary to have a suitable rotary element design. For the invention disclosed herein, and for the case where the vanes (fins, etc.) that are not radially distributed, the inventors have found particularly advantageous that preferably the determination of the profiles of the vanes is conducted as set forth in certain analytical models reported in scientific literature, which describes the liquid flow on a rotating disk prior to centrifugal atomization and the prediction of liquid metal velocities on a rotating disk [Zhao, Y. Y et al., Adv. Powder. Metall. Part. Mater., Vol. 3, p.p. 9/79-9/89, 1996; Zhao, Y. Y, et al., Metall. Mater. Trans. B, Vol. 29(6), p.p. 1357-1369, 1998]. The developed mathematical models are capable of predicting the changes in the thickness profile and in the radial and tangential velocities of the liquid metal as functions of the radius of the disk, the liquid kinematic viscosity, the volume flow rate, the metallostatic head, and the disk rotation speed. By using the predicted values of velocity it can be possible to measure and calculate the flow lines of the liquid metal on the atomizing rotating element. According to these models, it can be said that the liquid metal flow is controlled primarily by the volume flow rate and by the metallostatic head for small radiuses and by the centrifugal forces for larger disk radii. In particular the inventors have seen that it is important to have the vanes or protuberances follow quite closely the predicted trajectory of the molten metal (flow lines calculated as indicated) preferably on at least 10% of the vane length, preferably at least 27%, more preferably at least 58%, even more preferably 88% or more and obviously 100% is also a desirable case.

In the previous paragraph when referring to the vanes following "quite closely" the predicted trajectory it is normally quantifiable in one of two ways depending on the final application intended. One way can be conducted by quantifying the maximum deviation, measured orthogonal to the predicted trajectory which should not exceed D/4, preferably it should not exceed D/6, more preferably it should not exceed D/8, more preferably it should not exceed D/15, and even more preferably D/50, where D is the disk diameter defined as $$\frac{D\max + D\min}{2},$$

where Dmax and Dmin are the maximum and the minimum diameter of the rotating element respectively. The other preferred way to quantify the deviation consists on evaluating the area defined by the surface defined by the area between the predicted trajectory and the curve defined by the closest point of the vane to the predicted trajectory; it should not exceed A/5, preferably it should not exceed A/12, more preferably it should not exceed A/50, and even more preferably it should not exceed A/100, where A is the total area of the rotating element.

In this document it is understood under protuberance any prominence or protrusion on the active surface of the rotating element. The active surface of the rotating element in this document is the surface in direct contact with the molten metal. That is to say, when the active surface of the rotating element is modellized or replicated through the surface generated by the rotation of a generatrix about an axis, and the axis and generatrix are chosen as to maximize the amount of the active surface of the rotating element is correctly replicated by this generated modified surface, then a protuberance as defined in this document is any portion of the real active surface of the rotating element that is not present in the modellized or generated surface (the surface obtained through the revolution of the generatrix about an axis).

In this document it is understood as the line of insertion the sequence of points defined by every cross section of the protuberance when advancing radially from the center to the verge of the rotating element and making the cross sections orthogonal to this advancement. The point of the line of insertion for every cross section is the mass center of the line or surface generated in the cross section by all points of coincidence of the protuberance and the generated surface.

The inventor has realized that a very peculiar case arises when a lid is placed on the rotating disk. Then the liquid metal has to flow in channels or vanes. While one would in principle expect this confinement to benefit the drag of the liquid regarding its impulsion within the active surface of the rotating element. Contrary to this expectation it has been seen, that unless some special measurements are taken, the powder will tend to be less spherical and with more satellites. This is probably due to the whirlpools generated in the molten metal. The first observation refers to the number of vanes which should be at least three when the temperature of the molten metal is high. (Here a high temperature of the molten metal can be considered to be 880° C. or more, preferably 1040° C. or higher, more preferably 1260° C. or higher, or even 1560° C. or higher). Preferably for this high temperature of the molten metal scenario, the number of vanes should be at least five, more preferably at least seven, or even at least nine. In the case of lower temperatures of the molten metal the number of vanes should be even bigger so that at least five vanes should be used, preferably at least seven vanes, more preferably at least nine vanes, or even at least eleven vanes. In this regard the investigators have found that for the case of high melting point alloys when proper material is used straight and radial vanes can be used and the better results are obtained when the number of them is preferably more than 6, preferably more than 9, more preferably more than 11, and even preferably more than 15. When it comes to the material used to construct the vanes is interesting to note that for some applications dealing with high melting point alloys the rotating atomizing element can be made of a refractory material, coated even using different refractory materials or even with the same material to be atomized from the group consisting of fused silicon, graphite, fully stabilized zirconia (FSZ), partially stabilized zirconia (PSZ), silicon carbide, silicon nitride, zircon, alumina, magnesia, AlN, C (graphite), BN, $Si_3N_4$, $MgZrO_3$, CaO, silicon alumina nitride (Si—AlON), $AlTiO_3$, $ZrO_2$, SiC, $Al_2O_3$, MgO, etc. $MgZrO_3$ coating, CaO, $ZrO_2$ $Al_2O_3$ performs well for high melting temperature alloys, like Ni alloys.

Also it has been observed that in the case of confinement of the liquid (channels or vanes), the melting temperature of the liquid processed plays a very important role. This comes as no surprise as it has been seen all along this document that not only the melting point but the nature of the liquid play a major role in the addressing of the challenge of obtaining highly spherical with little satellites and narrow size distribution metal powder. So for many systems, and specially the iron system followed by the nickel and titanium systems, every composition poses a different challenge. Also the superheating of the melt has a strong influence on the rotating element design and nature and necessary process parameters, but in this document the superheating is considered a process parameter per se. Besides the differences already pointed out in the preceding paragraphs when it comes to active surface of the rotating element design, it has been observed that low melting point alloys will often require a greater superheating than higher melting point alloys.

In this case the previous considerations of design, where the degree of slippage was a limiting factor, are still valid. The inventors have seen that for some applications of the compositions of the present invention it is preferable to have a metallic disk, which does not react with the molten metal, with high mechanical properties; preferably high thermal conductivity and high melting temperature. For some special applications of the alloy compositions of the present invention the best disk configuration takes place with a ceramic disk of high thermal conductivity (e.g. BN, AlN . . . ). Also, the inventors have seen that, depending on the metal to be atomized and for some applications of the compositions of the present invention, it is recommended to coat the rotating element with a stable compound of the liquid metal to be atomized (e.g. single layer, multiple-layer, . . . ).

The inventors of the present invention also have seen that the implementation and management of higher feeding rates of molten metal it is possible when the geometry of the rotating element allows the distribution and flow of the liquid metal or liquid metal drops in a normal direction to the surface of the base of the rotating element. Such liquid metal distribution is promoted by the action of a certain number of vanes (channels, guides, fins, protuberances . . . ) of involute or evolvent variable geometry. In this sense, the inventors have found that it is advantageous to have a number of vanes (e.g. single or double curvature . . . ) greater than 2, more preferably greater than 3, even more preferably greater than 5 or even more; located in a radial geometrical layout or in any other appropriate layout to the purpose of atomization. According to the inventors of the disclosed invention, and when it comes to straight radial vanes, the better results are obtained when the number of them is preferably more than six and the transversal section or the cross-section of the vanes has no straight edges or segments (i.e. triangle, square, trapeze, etc.). Moreover, in this case, and for most applications for high melting temperature materials, it will be appropriate to keep the diameter of the rotating element above to 80 mm, preferably above to 120 mm and even more preferably above to 200 mm or even more. Regardless the geometry of the rotating element the inventors believe suitable and appropriate to use, depending on the application, a serrated edge on the perimeter of the rotating element in order to encourage a more uniform droplet size distribution and increase the quality of the atomization process. For all configurations, the inventors have found that it is advantageous that the values of wettability, quantified by the contact internal angle between the liquid and a solid surface, have to be less than 90°, preferably below 65°, more preferably below 40°, even more preferably below 25° or even below 5°.

The material of the atomizing rotating element exhibits a melting temperature higher than 1400° C., a mechanical strength higher than 680 MPa and is coated with a material that promotes a wettability lower than 90° with the alloy that is intended to be atomized. When the molten metal is poured on the spinning disk, and under the action of centrifugal forces, the particles are released from the periphery of the disk and projected in an outwardly direction into the atomization vessel itself. The atomized particles begins to solidify, in contact with the atmosphere of the atomization chamber, following a parabolic flight path. After solidification, the particles continue cooling down to room temperature. The funnel-shaped geometry of the lower part of the atomization vessel makes it possible to collect the produced powder from the bottom.

As has been mentioned, and for a given material, the desired particle size distribution can be controlled manly by controlling the angular velocity rate (rpm) and the diameter of the atomizing element.

The post-processing of the sintered parts (apparent and sintered density, flowability, sinterability, compressibility, etc.) are strongly affected by certain characteristics of the powder, such as: (i) particle shape, size and distribution, (ii) microstructure, (iii) surface condition and (iv) purity. A very important parameter is the apparent density (AD) of the particulate material, since this strongly influences the strength of the compacted part, obtained on the pressing operation. The AD is a function of particle shape and degree of porosity thereof. Likewise, the purity and the surface condition of the powder are critically important. The presence of stable oxide films or included oxide particles (e.g. $SiO_2$ and $Al_2O_3$), that cannot be reduced during subsequent sintering, may unfavorably affect the mechanical properties of the finished part.

The iron-based alloy powders, object of the present invention, are obtained with mean particle sizes ($d_{50}$) of less than 800 μm, preferably less than 500 μm, more preferably less than 200 μm, even more preferably less than 100 μm or even less than 45 μm. Nevertheless for some special applications (e.g. shot production . . . ) it is preferable to have a minimum mean particles sizes of less than 280 μm, preferably above 400 μm, more preferably above 700 μm and even more preferably above 1,000 μm or even above to 3,000 μm.

The inventors have seen that with the compositions of the present invention and with the optimized parameters of atomization it is possible to obtain metallic powders or particulate matter with a geometric standard deviation distribution of 1.7 or less, preferably of 1.5 or less, more preferably 1.4 or less and even of 1.3 or less.

The sphericity of the powder, is a dimensionless parameter defined as the ratio between the surface area of a sphere having the same volume as the particle and the surface area of the particle and for some applications it may be preferably greater than 0.53, more preferably greater than 0.76, even more preferably greater than 0.86, at least 0.92 and even more preferably greater than 0.92. Particles falling within these parameters are considered to be "quasi-spherical". When the present invention is particularly well applied and the most powder processing parameters are take into consideration as explained herein a high sphericity of the metallic powder can be achieved preferably greater than 0.92, more preferably greater than 0.94, even more preferably greater than 0.98 and even 1. When speaking of sphericity the authors refer to the average sphericity of the 60% of the volume of produced powder or more, preferably 78% or more, more preferably 83% or more and even more preferably 96% or more.

The production process of the present invention permits mass-production of spherical metallic particulate material having smooth surfaces with oxygen ($O_2$) concentrations (extra oxygen concentration) below to 1,200 ppm, preferably below to 800 ppm, more preferably below to 500 ppm and even more preferably below to 100 ppm. It is important to mention that the introduction of oxygen can modify the shape of the particle of certain alloys. Accordingly, and for some other applications, the powder oxygen concentration can present a minimum value of 650 ppm, preferably above to 1,000 ppm, more preferably above to 1,450 ppm and even more preferably above to 1,600 ppm.

Depending on the alloy, and for a given particle size and morphology, the apparent density of iron-based powders, objects of the present invention, can be above to 3 $g \cdot cm^{-3}$, preferably above to 3.5 $g \cdot cm^{-3}$, more preferably above to 4 $g \cdot cm^{-3}$ and even more preferably greater than 4.7 $g \cdot cm^{-3}$. For most of the compositions of the present invention in some cases it is advantageous to use a powder apparent density below to 3.8 $g \cdot cm^{-3}$, preferably below to 3.3 $g \cdot cm^{-3}$, more preferably below to 2.8 $g \cdot cm^{-3}$ and even below to 2.5 $g \cdot cm^{-3}$.

Usually the product should be between some lower and upper allowable diameters and the cumulative distribution may be used to obtain a yield or yield efficiency, defined as the ratio between the mass of usable product between size limits and the total mass of product. Always is interesting maximize the yield in order to maximize production and minimize associated costs. In the case of the powder obtained through the technique and with the chemical composition disclosed in the present invention is desirable to have a yield efficiency greater than 0.5, preferably above to 0.65, more preferably above to 0.75, and even more preferably above to 0.9.

The use of inert gas to fill and create the atomization chamber atmosphere can promote the entrapment of small amounts of gas within the particles, which can cause internal porosity; especially in the case of Ar and for coarse particles. The fine, spherical or near-spherical shaped, smooth, low oxygen content and free-satellite metallic powder produced, as a result of the application of the present invention, can be exhibit a low percentage of internal porosity generally lower than 10%, preferably lower than 7%, more preferably lower than 3% and even lower than 0.5%. For applications that do not require excessive control of the powder internal porosity an internal porosity percentage above 5%, preferably above a 9%, more preferably above a 12% or even above a 20%, can be accepted. Usually porosity is undesirable and there are two reported important mechanisms that produce it: entrapment during flight and dissolved gases. Entrapment is almost always related to the largest particles and it can be minimized significantly through screening off the coarse end of the distribution, while the presence of dissolved gases, such as H, can be controlled through a careful practice and selection of raw materials.

The operating conditions for obtaining the powder include the use of non-oxidizing atmospheres of Ar, and/or He, and/or N and/or a combination of some or all of them in different proportions, according to specifications. The atomization and melting chambers contain an atmosphere of one or more predetermined gases. The pressure in chambers is controlled by regulating the inlet gas flow and also is controlled by the vacuum level exerted by the vacuum pump system. Normally, the pressure in atomization chamber is set a little bit lower than the pressure in the melting chamber. This configuration causes the melted metals and alloys to flow in a predetermined quantity from the nozzle due to the pressure gradient. The inventors have seen that the present invention can be used with almost any combination of vacuum, limited pressure, several partial pressures of a combination of gases or even over-pressure, depending on the properties of the powder desired. The inventors have seen that for applications very sensitive to surface oxidation it is possible to operate with vacuum levels of $1.10^{-3}$ mbar or less, preferably $1.10^{-4}$ mbar or less, more preferably $1 \cdot 10^{-5}$ mbar or less, even more preferably of $1 \cdot 10^{-6}$ mbar and even $1.10^{-7}$ mbar or less. Obviously, filling the atomization chamber with a particular gas and posterior purging can be of further advantage for some applications. The inventors have also seen that for applications requiring high undercooling rates and special morphology features one possible preferred way is to keep a gas over-pressure in the atomization chamber of 2.5 bar or more, preferably 1.5 bar or more, more preferably 0.9 bar or more and more preferably 0.6 bar or more.

The invention is suitable for the production of steel powder, especially tool steel powder and some other iron-based alloys of similar properties. This practice has been implemented using different base alloys, reheating temperatures, a number of disk materials and geometries (flat disk, cup, etc.), angular velocities of the rotary part, several inert atmospheres (Ar, N, He, or mixture) and including diverse levels of vacuum and melting feed rates or throughputs.

According to scientific literature in centrifugal atomization there are three basic droplet formation modes accepted namely: (i) the direct drop formation (DDF) mode, (ii) the ligament formation mode (LF) mode and (iii) formation disintegration (FD) or film disintegration mode. Although these models were conceived for the rotating electrode process their analysis is perfectly applicable to centrifugal atomization in general. The DDF mode occurs at relatively small rotating speeds and small flow rates of liquid supply. This mode is characterized in that a large number of bulges are form as a consequence of the balance between centrifugal force and the surface tension of the liquid metal. When the centrifugal force is higher than the surface tension value, droplets are separated and ejected from the bulges. The major part of the bulges form the main drops and usually its tail becomes in satellites. Therefore, the typical powder size distribution in this mode has two peaks with equal numbers of large and small droplets. The LF mode occurs when the rate of supply of molten metal at the periphery of the atomizing element increases. Here the bulges develop a larger amplitude than in the DDF mode before Rayleigh instability breaks up the elongated ligaments. Droplet size increases and, though still bimodal, the weight fractions of the small and large droplets become similar as the liquid supply rate increases. When the liquid flow rates are very high, ligaments become unstable and the disintegration mode changes gradually to formation disintegration or film disintegration (FD) [O.D. Neikov et al., Elsevier Science (2009), 1st Ed., ISBN-13: 978-1856174220]. Champagne and Angers [Champagne, B., Angers, R., Int. J. Powder Metall. Powder Tech., Vol. 16(4), p.p. 359-364, 1980; Champagne, B., Angers, R., Powder Metall. Int. Vol. 16 (3), p.p. 125-128, 1984.] discovered that the ratio of two particular parameters determines the transitions from the DDF to the LF and LF to the FD modes:

$$X = \frac{Q\omega^a}{D^b} \Big/ \frac{\sigma^c}{\eta_L^d \rho_L^e},$$

where a, b, c, d and e are numerical constants, Q is the liquid supply rate ($m^3 \cdot s^{-1}$), co is the angular velocity of the anode ($rads \cdot s^{-1}$), D is the anode diameter (m), σ is the surface tension ($N \cdot m^{-1}$), $\eta_L$ is the dynamic liquid metal viscosity (Pa·s) and $\rho_L$ is the density of the liquid ($kg \cdot m^3$). As can be observed the numerator includes only process variables while the denominator includes only the material variables. Increasing the melting rate and the angular velocity and decreasing the atomizing rotating diameter the transition from the DDF to the LF mode and finally to the FD mode will be promoted. Using this approach for the process and material variables, the DDF to LF mode change occurs when X is equal to 0.07.

The major drawback of the aforementioned formulation lies in that especially for materials with high density, high viscosity and relatively low surface tension the flow rate of liquid metal to operate within the DDF mode tend to be small. Working with pure metals such as Fe and Ni, and to obtain an average particle size of about 120 μm and using a flat disk of 120 mm in diameter, the theoretical flow rate of liquid metal must be about 42 $kg \cdot h^{-1}$ and 50 $kg \cdot h^{-1}$ respectively.

According to the literature, traditionally in the centrifugal atomization only small feed rates are practicable, especially when fine powders are desirable and for alloys with a melting point above 930° C. This makes the process far less cost effective than it could be given the low amount of specific energy required for the atomization. CA can achieve higher throughputs, however the quality of the particle size distribution can be affected. The inventors have found that this limitation can be overcome with proper selection of the composition of the alloy to be melt and proper design of the atomizing rotating element and the proper selection of the process parameters (gas chamber atmosphere, gas pressure, atomizing rotating element geometry and size, rotating speed, metallostatic head, overheating temperature, metal liquid flow rate, . . . ) and with the compositions of the present invention, the molten metal can flow from the nozzle at a feed rate of 55 $kg \cdot h^{-1}$ or more, preferably at least 120 $kg \cdot h^{-1}$, more preferably 230 $kg \cdot h^{-1}$or more and even 560 $kg \cdot h^{-1}$ or more. However for applications with special requirements of powder morphology, and with the compositions of the present invention, it is advantageous that the molten metal can flow from the nozzle at a maximum feed rate of 180 $kg \cdot h^{-1}$, preferably below to 90 $kg \cdot h^{-1}$, more preferably below to 40 $kg \cdot h^{-1}$ re and even below to 22 $kg \cdot h^{-1}$.

With some cases and for some compositions of the present invention is not convenient to work with large feed rates of molten metal. In those cases it is more suitable to work with pre-alloyed ingots and using a system of partial melting or refining that can run on different energy sources (e.g. electric arc plasma, electron beam, flame torch, . . . ), or even better a system of refining such as electric arc refining or remelting, etc. During the refining process stage it is possible also add an additional overheating stage that can comprise different energy sources; for example, induction heating, resistance heating, etc.

For a given feed rate, metal composition, disk geometry and rotating speed amongst others, the mean particle sizes can also be affected by the distance between the nozzle and the rotating disk, also known as the metallostatic head. For most of the compositions of the present invention it is advantageous to use a distance from the nozzle to the disk smaller than 0.27 m, preferably smaller than 0.18 m, and more preferably equal or below to 0.08 m, or even below 0.04 m. But for some compositions and especial applications it is preferably to have a minimum distance of 0.12 m or above, preferably 0.24 m or above, more preferably 0.28 m or above, and even 0.34 m or above.

In centrifugal atomization, the success in obtaining metallic powder with certain particularities, both morphological and physical and/or mechanical properties, etc., that make it suitable for certain applications depends mainly on the chemical composition of the metal or alloy and on the atomization process parameters, some of which are cited herein. For a given chemical composition, the chosen process parameters of atomization determine or promote that the morphological, physical and/or mechanical properties are different. Obviously this is the case when different atomization techniques are applied and where powder properties are different and, as has been mentioned above, for a given atomization technique these properties depends on the atomization parameters used and on the material chemical composition.

Consequently it is not surprising that similar or equivalent compositions, subject to identical atomization parameters, promote different powder properties; e.g. morphological, physical and/or mechanical properties, etc.

The inventors have found that surprisingly when a different technique of atomization is used, for a given chemical composition, the optimum particle size to maximize some of the aforementioned properties of the consolidated product is different and it depend on the applied atomization technique.

Frequently, the bulk of centrifugally atomized powder or particles exhibit a mixture of FCC and BCC phases. The volume fraction of the FCC phase shows a strong particle size dependence; the greater the particle size the greater the volume fraction of FCC. Likewise, the bcc (retained at room temperature) volume fraction increases with decreasing particle size. Finally, the presence of any phase, as a function of particle size, is associated with the available heterogeneous nucleation sites. Generally, due to the solidification rate of the centrifugal atomization technique, microstructure result in a dendritic and/or cellular microstructure. For some applications it is necessary that the amount of metastable austenite contained in the powder remain above to 90%, preferably above to 92%, more preferably above to 95% and even more preferably above to 99% vol. However for other applications it is necessary that the amount of metastable austenite remain below 90%, preferably below 85%, more preferably below 80% and even more preferably below 60% vol.

The metallic powder, or particulate material obtained, is also apt for cold spraying applications, where the most frequently requested particle size (diameter of particles) are normally below to 150 μm, preferably below to 75 μm, more preferably below to 63 μm and even below to 15 μm. The particle velocity, the interaction of individual particles with the substrate, the critical velocity of particles and jet temperature, among others, the main variables that control the cold spraying process efficiency. For some applications it is necessary to have larger powder sizes that can remain above to 25 μm, preferably above to 45 μm, more preferably above to 90 μm, even preferably above to 200 μm or even higher than 400 μm.

In the case of Titanium alloy and specially when alloyed with aluminum, it has been observed that it is important to chose the right rotating element geometry to provide good acceleration of the metal independently of the wettability of the material of the rotating element with the molten alloy.

Also for most Ni base alloys the same should apply, although in this case there are some ceramics with a good wettability and where the molten metal is not excessively erosive.

The inventor has observed that in the case of some iron based materials quite spherical particles can be obtained even when there is a thermodynamically predicted reaction between the molten metal and the gas in the atomization chamber, but the surface modifications that take place can be detrimental and unacceptable for many applications. One such observed case is the one for iron based alloys where the pondered amounts of Cr, Al and Si are not sufficient, and the gas in the chamber has a high enough partial pressure of $O_2$ or a gas that can react to liberate enough $O_2$ during the atomization process. While the particles mostly tend to have the desired geometry, some present a quite thick oxide crust and even some might present voids inside. These particles are not acceptable for most additive manufacturing processes, metal deposition processes, addition to paints and inks, etc. Even for powder intended to be processed to HIP or another compacting method, in most cases the powder is not recoverable, just in some cases powder might only be acceptable if processed through a costly reducing process. This effect seems to be more pronounced the finer the manufactured powder is. In this case when powder has high % Cr (normally more than 9.8%, preferably more than 10.6% more preferably more than 12.8%) it can be atomized in atmospheres with quite high oxygen partial pressures but to obtain fine spherical or quasi spherical powder in this circumstances either special attention has to be played to the design of the rotating element to provide sufficient acceleration to the powder or even better some compositional rules have to be observed, like is the presence of % C, % Si, % Al, % Ti or % Ni (which are believed to affect the surface energy, especially in reactive atmospheres) (It is desirable to have at least a 0.5% of the sum of these elements, preferably more than a 1.2%, more preferably more than 2.1% and even more than 3.2%). Alternatively Carbon (alternatively nitrogen or boron) has to be present together with some carbide forming elements with higher affinity for % C than chromium, preferably % Mo, % W, % V and % Ti (It is desirable to have at least a 0.5% of the sum of these elements, preferably more than a 1.6%, more preferably more than 2.8% and even more than 4.2%)(and when it comes to % Ceq it is desirable to have at least 0.14% a preferably more than a 0.18%, more preferably more than 0.32% and even more than 1.2%). Even for atmospheres of low partial pressure of oxygen, when a metal is processed with especially low chromium content (less than 3.4%, preferably less than 2%, more preferably less than 0.8% and even less than 0.3%) then again it has been observed that carbide formers with higher affinity than Chromium should be present if spherical or quasi-spherical fine powder is to be obtained without special optimization of the rotating element geometry. A low partial pressure of $O_2$ is any pressure lower than 0.05 bar, preferably lower than 0.001 bar, more preferably lower than 0.0001 bar and even lower than 0.000001 bar.

It has also been observed that in iron based alloys some alloying elements strongly affect the flowability strongly compromising the possibility of obtaining sound spherical or quasi spherical powders trough centrifugal atomization unless special care is taken with the rotating element design and the process parameters. Such elements are % Si, % Mn, % Ni and even % Cr, % Mo, % V and % Cr when present in big amounts, but very specially % Ceq and % Co. In the case of Cobalt, the simultaneous presence of certain elements (believed to affect the surface tension) can be very beneficial like % Ni, % Al, % Ti and % Si. (It is desirable to have at least a 0.3% of the sum of these elements, preferably more than a 0.5%, more preferably more than 1.2% and even more than 3.2%.)

The inventor has observed that in the case of Ti base alloys a point to be taken into account and which strongly depends on the particular composition being atomized relates to the gas entrapment in the powder, especially when light gases are present during the atomization process.

In the present invention is crucial for ever composition chosen to properly balance the nature of the atmosphere in the atomization chamber in terms of gas mixture and pressure. Some strict rules have to be observed to make sure the superficial energies are compensated to be able to obtain powder morphologically sound. Also the superheating of the liquid metal and the rotating element active surface design and nature, especially in terms of protuberances, have to be adjusted to the alloy composition being atomized and the chamber atmosphere chosen. The main rule to take into account is to maximize the surface energy of liquid metal and chamber atmosphere, The augmented Young-Lapplace differential equation can be employed for this purpose and also the Kelvin equation with the proper molar volume of the liquid which depends on the processed metal composition. This is a way to optimize some of the process parameters like superheating, atomization chamber pressure and even rotating element geometry for a given composition to be atomized in fine spherical or quasi-spherical powder.

The authors have observed that the following compositional rules need to be followed to be able to atomise fine spherical or quasi spherical powder through centrifugal atomisation with a rotating element, with almost any rotating element geometry; all percentages are in weight percent (wt. %):

| | | | |
|---|---|---|---|
| % Ceq = 0.001-2.8 | % C = 0.001-2.8 | % N = 0.0-2.0 | % B = 0.0-2 |
| % Cr = 0.0-20.0 | % Ni = 0.0-25.0 | % Si = 0.0-3.0 | % Mn = 0.0-7.0 |
| % Al = 0.0-6.0 | % Mo = 0.0-11.0 | % W = 0.0-16.0 | % Ti = 0.0-3.0 |
| % Ta = 0.0-2.0 | % Zr = 0.0-10.0 | % Hf = 0.0-4.0 | % V = 0.0-15.0 |
| % Nb = 0.0-4.0 | % Cu = 0.0-5.0 | % Co = 0.0-15.0 | % Ce = 0.0-2 |
| % Ca = 0.0-1 | % P = 0.0-2 | % S = 0.0-2 | % As = 0.0-2 |
| % Bi = 0.0-1 | % Pb = 0.0-2 | % Sb = 0.0-1 | % Li = 0.0-1 |

-continued

| | | | |
|---|---|---|---|
| % Te = 0.0-2 | % Zn = 0.0-1 | % Cd = 0.0-1 | % Sr = 0.0-1 |
| % K = 0.0-1 | % Na = 0.0-1 | | |

the rest consisting of iron and trace elements characterized in that:

% Ceq=% C+0.86·% N+1.2.% B

Wherein:

When % Co>0.9 then % V>1.2 and/or % Ni+% Al+% Ti+% Si>0.3 and/or Cr<0.8

When % Cr>9.8 then % Ceq>0.14

When % Cr>9.8 then % Mo+% W+% V+% Ti>0.5 and/or % Si+% Al+% Ti+% Ni>0.5

When % Cr<2 then % Mo+% W+% V+% Ti>0.5 where, % Ceq, which is defined as carbon upon the structure considering not only carbon itself, or nominal carbon, but also all elements which have a similar effect on the cubic structures of the steel, normally being B and N.

For example the steel powder may have % C<0.1, with the proviso that when % Ni≥0.9% and % Co≥0.9, then % Si<0.4.

Of course effectiveness is still strongly influenced by rotating element geometry chosen.

In the meaning of this patent, trace elements refer to any element, otherwise indicated, in a quantity less than 2%. For some applications, trace elements are preferable to be less than 1.4%, more preferable less than 0.9% and sometimes even more preferable to be less than 0.78%. Possible elements considered to be trace elements are H, He, Li, Be, O, F, Ne, Na, Mg, P, S, Cl, Ar, K, Ca, Sc, Fe, Zn, Ga, Ge, As, Se, Br, Kr, Rb, Sr, Y, Tc, Ru, Rh, Pd, Ag, Cd, In, Sn, Sb, Te, I, Xe, Cs, Ba, La, Ce, Pr, Nd, Pm, Sm, Eu, Gd, Tb, Dy, Ho, Er, Tm, Yb, Lu, Re, Os, Ir, Pt, Au, Hg, Tl, Pb, Bi, Po, At, Rn, Fr, Ra, Ac, Th, Pa, U, Np, Pu, Am, Cm, Bk, Cf, Es, Fm, Md, No, Lr, Rf, Db, Sg, Bh, Hs, Mt alone and/or in combination. For some applications, some trace elements or even trace elements in general can be quite detrimental for a particular relevant property (like it can be the case sometimes for thermal conductivity and toughness). For such applications it will be desirable to keep trace elements below a 0.4%, preferably below a 0.2%, more preferably below 0.14% or even below 0.06%.

Should be noted that in this case each of the aforementioned individual trace elements may exhibit different content values. Hereafter, in reference to chemical compositions, obviously when a certain value of composition is referred as smaller or equal than a certain numerical value also means that it can take the value of zero.

For the process developed in the present invention, the inventors have seen that centrifugal atomization has to be applied to the compositions described as follows. In metallurgical terms, composition of steels is often given in terms of % Ceq. The present invention works particularly good when % Ceq is more than 0.62%, preferably more than 0.86%, more preferably more than 1.51% and even more preferably more than 1.96%.

For applications requiring high wear resistance it will be desirable that % Ceq is more than 2.31%, preferably more than 3.21%, more preferably more than 3.55% and even for special cases more than 4.23%.

For some applications of the present invention it is important to have % Ceq of less than 1.6%, preferably less than 1.40%, more preferably less than 1.24% and even more preferably less than 0.99%. For other cases, the requirements in this sense have to be even more stringent and then it is desirable to have % Ceq of less than 0.88%, preferably less than 0.76%, more preferably less than 0.64% and even more preferably less than 0.55%. The present invention is also applicable for medium carbon iron alloys or tool steels where it is desirable to have % Ceq less than 0.48%, preferably less than 0.37%, more preferably less than 0.34% and even less than 0.29%. In addition, the present invention is also applicable for low carbon iron alloys or tool steels where it is desirable to have % Ceq less than 0.25%, preferably less than 0.19%, more preferably less than 0.11% and even less than 0.06%.

However, when defining the mechanical properties of a material for use or for atomization, it is useful to differentiate between the % Ceq content and % C content for carbide forming. The present invention works particularly good when % C is more than 1.47%, preferably more than 1.69%, more preferably more than 2.21% and even more preferably more than 2.75%. Sometimes it will be desirable that % C is more than 3.29%, preferably more than 3.96%, more preferably more than 4.03% and even for special cases more than 4.88%. The present invention is also well suited for % C of less than 1.57%, preferably less than 1.05%, more preferably less than 0.89% and even more preferably less than 0.79%. For other cases, the present invention also performs well for % C of less than 0.68%, preferably less than 0.57%, more preferably less than 0.47% and even more preferably less than 0.41%. The present invention is also applicable for % C less than 0.39%, preferably less than 0.35%, more preferably less than 0.32% and even less than 0.28%. The present invention can also be applied to steels presenting % C less than 0.20%, preferably less than 0.11%, more preferably less than 0.08% and even less than 0.04%, but not less than 0.009%.

For the present invention, carbide formers need also to be taken into account. When it comes to % Cr, it will be desirable to have more than 0.5%, preferably more than 0.66%, more preferably more than 0.73% and even more preferably more than 0.87%. The present invention is also very well suited for steels presenting % Cr of more than 1.9% Cr, preferably more than 3.11%, more preferably more than 6.31% and even more preferably more than 9.69%. The present inventions is also indicated for % Cr contents of more than 11%, preferably more than 12.8%, more preferably more than 14.49%, more preferably more than 17.8% and even more preferably more than 22.7%. In some cases % Cr even 32.5%. For other applications requiring low Cr content, the present invention is also indicated, above all when % Cr is less than 0.51%, preferably less than 0.45%, more preferably less than 0.33% and even more preferably less than 0.27%. The present invention is very well indicated for % Cr of less than 0.19%, preferably less than 0.15%, more preferably less than 0.10% and even more preferably less than 0.06% When it comes to % Mo, the present invention is suitable for steels presenting at least 2.10% Mo, preferably more than 3.01%, more preferably more than 3.62% and even more preferably more than 4.78%. The present invention is also suitable for steels presenting more than 5.61% Mo, preferably more than 7.55%, more preferably more than 8.41%, even more preferably more than 9.34% and even more than 10.99%. The present invention is also usable for steels presenting % Mo less than 2.2%, preferably less than 1.66%, more preferably less than 0.77% and even more preferably less than 0.54%. It is also possible to use less than 0.43%, preferably less than 0.19% and even less than 0.04%.

When it comes to the % W, it is possible within the present invention to use % W of more than 2.33%, preferably more than 3.64%, more preferably more than 4.31% and even more preferably more than 5.79%. It is also possible to use values of more than 7.46%, preferably more than 9.27% and even more preferably more than 10.58%. It is also possible to use it for values of more than 12.3% and even more than 16%. The present invention is also suitable for % W of less than 2.41%, preferably less than 1.87%, more preferably less than 0.21%, even more preferably less than 0.08 and even absence of it.

When it comes to % V, the present invention is doable when % V is more than 0.4%, preferably more than 0.59% more preferably more than 0.89% and even more preferably when it is more 1.05%. The present invention is also applicable when % V is more than 2.64%, preferably when it is more than 4.35%, more preferably when it is more than 5.33% and even more preferably when it is more than 6.02%. It is also applicable for values of more than 9.15%, more than 10.22%, preferably more than 13.54% and even more preferably more than 15%. It is also possible to use the present invention for values of less than 0.41%, preferably less than 0.27%, more preferably less than 0.11% ad even more preferably for less than 0.04%.

When it comes to other carbide formers such as % Hf, % Ta, % Zr and/or % Nb, the present invention can be used when the sum % Zr+% Hf+% Nb+% Ta is more than 0.09%, preferably more than 0.43%, more preferably more than 1.87% and even more preferably more than 3.89%. It is also possible for values of more than 5.55% and even more than 10%. Obviously, hereafter and when talking about these type of conditions, the sum may be composed of each of the elements individually or as a combination thereof.

The present invention is also suitable when % Cr+% V+% Mo+% W+% Zr+% Hf+% Nb+% Ta is more than 4.5%, preferably more than 7.8%, more preferably when it is more than 11.5% and even more preferably when it is more than 20%.

The present invention is usable for steels presenting % Si of more than 0.4%, preferably more than 0.89%, more preferably more than 1.73% and even more preferably more than 2.8%. It is also possible to use the present invention when % Si is less than 0.42%, preferably less than 0.38%, more preferably when it is less than 0.1% and even more preferably when it is less than 0.04%.

The present invention is usable for steels presenting % Mn of more than 1.75%, preferably more than 3.47%, more preferably more than 5.06% and even more preferably more than 6.98%. It is also possible to use the present invention when % Mn is less than 1.87%, preferably less than 0.76%, more preferably when it is less than 0.42% and even more preferably when it is less than 0.1%.

The present invention is usable for steels presenting % Ni of more than 0.9%, preferably more than 1.98%, more preferably more than 3.5% and even more preferably more than 4.01%. It is also possible to use the present invention when % Ni is more than 7.28%, preferably more than 11.34%, more preferably when it is more than 15.76% and even more preferably more than 28.31%. It is also possible to use the present invention when % Ni is less than 0.8%, preferably less than 0.52%, more preferably when it is less than 0.31% and even more preferably when it is less than 0.08%.

The present invention is usable for steels presenting % Co of more than 1.5%, preferably more than 3.81%, more preferably more than 7.42%, even more preferably more than 13.8% and even more than 16%. It is also possible to use the present invention when % Co is less than 1.61%, preferably less than 0.44%, more preferably when it is less than 0.11% and even more preferably when it is less than 0.08%.

More guidance for determining the composition depending on some applications or properties sought is given below.

For example when it comes to the % Ceq content, for applications requiring ultra-high strength, it is desirable that % Ceq is less than 0.1%, more preferably less than 0.09% and even more preferably less than 0.05%. If toughness is to be improved, then % Ceq is better be kept below 0.03%, preferably below 0.01% and even more preferably below 0.001%. For certain applications in which excellent mechanical properties (strength, hardness, weldability, abrasion and wear resistance, hardenability and toughness) and superior fabricability are needed, and for alloys containing % Ni greater than or equal to 8% and containing Co greater than or equal 4%, the mass content of Si should be preferably less or equal to 0.4%, more preferably less or equal than 0.3%, even more preferably less or equal than 0.2% or even smaller or equal than 0.1%. High hardness and strength is achieved by Ni contents of preferably more than 10%, preferably more than 18%, more preferably 18.5% and even more preferably more than 25%; Co is preferred normally above 8%, preferably above 9.5% and depending on the application, even above 12%; Mo is preferred to be more than 2.5%, preferably more than 4% and even more preferably more than 5%. If some corrosion resistance is sought, then an addition is preferred normally in an amount of at least 4%, preferably more than 5% and even more preferably more than 10%. Some other elements like Ti, Mn, Al, etc. are preferred to be present in an amount from 5% to 9% depending on final properties. As Co reduces the solubility of Mo in the matrix, sometimes Co is preferably desired to be less than 2%, less than 1.5% even more preferably less than 0.5% and even absence of it. Then % Ti+% Mo should be above 3.5%, preferably 4.5% and even 6% at the higher levels of Ni. For other applications, % Ceq is preferable to have a minimum value of 0.2%, preferably 0.29 and more preferably more than 0.31%. In such cases it is highly recommended to have % Moeq (% Mo+½ ·% W) present in the steel, often more than 2%, preferably more than 3.1% and even more preferably more than 3.7%. If thermal conductivity properties are to be maximized, then % Ceq content it is preferably to have a minimum value of 0.22% or even 0.33% but below 1.5%, more preferably below 1.1% and more preferably below 0.9%. Also the % Moeq (% Mo+½·% W) levels should be higher for maximum thermal conductivity, normally above 3%, often above 3.5%, preferably above 4% or even 4.5%. % Cr will be preferred to be less than 2.8% preferably less than 1.8% and even less than 0.3%. If the cost is not to be considered, then for very high thermal conductivity % Cr should be even more preferably less than 0.06%. In such cases also % Si should be as low as possible, preferably less than 0.2%, more preferably less than 0.11%, and even more preferably less than 0.09%. For applications where thermal conductivity has to be combined with some wear resistance and toughness, % V can generally be used, with a content above 0.1%, preferably 0.3% and most preferably even more than 0.55%. For very high wear resistance applications it can be used with a content higher than 1.2% or even 2.2%. For increasing hardenability Ni and/or Mn, are used. Thus for heavy sections it is often desirable to have a minimum % Ni content normally more than 0.85%, preferably more than 1.5% and for special cases even more than 3.1%. If % Mn is used, it is required around double contents, being preferable more than 1.74%, more preferable more than 3.1% and in some cases even more than 6.2%. The presence of Ni is also favorable to decrease thermal expansion coefficient having a positive effect on the durability of the piece, therefore contents of more than 0.5%, preferably more than 1.6% and even 2% are desirable. On the other hand it has a negative effect on thermal conductivity so fur such cases it will be desirable to be less than 0.4%, preferably less than 0.2% and even more preferable less than 0.09%. For applications where the steel is to attain temperatures in excess of 400° C. during service it might be very interesting to have % Co present which tends to increase tempering resistance amongst others and presents the odd effect of affecting the thermal diffusivity positively for high temperatures. Although for some compositions an amount of 0.8% might suffice, normally it is desirable to have a minimum of 1% preferably 1.5% and for some applications even more than 3.1%. If not specifically needed for an application, % Co will normally be below 0.6%, more preferably below 0.35% and even more preferably below 0.1%. In cases in which the Co content is greater than 0.9%, then it is preferable that the V content can be preferably greater than 1.2%. Applications where toughness is very important favor lower % Ceq contents, and thus maximum levels should remain under 0.8%, preferably 0.6% and for very high toughness under 0.48%. Noticeable ambient resistance can be attained with 4% Cr, but usually higher levels of % Cr are recommendable, normally more than 8% or even more than 10%. For some special attacks like those of chlorides it is highly recommendable to have % Mo present in the steel, normally more than 2% and even more than 3.4% offer a significant effect in this sense. Corrosion resistance can be attained with 11% Cr, but is preferable to have more than 12% or even more than 17%. For some special applications it can be interesting to have % C less than 0.5%, preferably less than 0.42% and more preferably less than 0.29%, but minimum content of 0.02%, preferably more than 0.04% and in some cases more than 0.06%. For other applications % C will be desirable to be more than 0.3% and preferably more than 0.4% but below 0.1% and preferably below 0.09%. In other cases, where wear resistance is of importance % Ceq is preferable to have a minimum value of 0.49%, preferably more than 0.64%, more preferably more than 0.82%, and even more preferably more than 1.22%. For extreme wear resistance it will be desirable to have more than 1.22%, more preferably more than 1.46% and even more than 1.64%. Very high levels of % Ceq are also interesting due to the low temperature at which martensite transformation starts, such applications favor % Ceq maximum levels of 0.8%, preferably 1.4% and even 1.8%. The same applies for applications where a fine bainite is desirable. In such cases it is desirable to have a minimum of 0.4% of Ceq often more than 0.5% and even more than 0.8%. If some other elements that reduce the martensite transformation temperature are present (like for example % Ni) then the same effect can be obtained with lower % Ceq (same levels as described before). For high wear resistance, it is advantageous to use stronger carbide formers than iron, generally it will be % Cr+% W+% Mo+% V+% Nb+% Zr and their content should be above 4%, preferably 6.2%, more preferably 8.3% and even 10.3%. Other interesting carbide formers stronger than iron are Zr, Hf, Nb, Ta, which % Zr+% Hf+% Nb+% Ta should be above 0.1%, preferably 0.3% and even 1.2%. Also % V is good carbide former that tends to form quite fine. For very high wear resistance applications it can be used with content higher than 3.2%, preferably higher than 4.2% or for extreme wear resistance levels even higher than 9.2%. For very high wear resistance applications it can be used with content higher than 6.2% or even 10.2%. If high weldability is sought % V will be desirable to be less than 0.2% or even less than 0.09% and instead Mo and/or W carbides will be used. Then, W will be preferably more than 0.5%, more preferably more than 0.9% and even more preferably more than 1.6% but below 4%, preferably below 3.2% and more preferably below 2.9%. % Mo will be preferably more than 1.2%, more preferably more than 3% and even more preferably more than 3.7% but below 5%, more preferably below 4.6% and even below 4.2%. For very demanding applications where, high levels of hardness as well as resistance at high temperatures and high speeds are required, % Ceq is preferable to have a minimum value of 0.89%, preferably more than 1.64%, more preferably more than 1.89% and even more preferably more than 2.7%. For some cases also other alloying elements are desirable to be as high as possible, for example W is preferred to be more than 3%, preferably more than 5% and in some cases even more than 7%, when it comes to Co, it will be desirable to be around 6% more preferable more than 9% and even more than 10%. % Cr has two ranges of particular interest: 0.6%-1.8% and 2.2%-3.4%. Particular embodiments also prefer % Cr to be 2%. Sometimes, for alloys containing % C equal or greater than 2% or containing Cr amounts equal or smaller than 10%, then % Cr+% Ti+% W+% Mo+% V+% Nb+% Zr+% Hf+% Co should be preferably equal or greater than 0.5%, preferably greater than 0.55% and more preferably greater than 0.7%. In one embodiment, % C<0.1, with the proviso that when % Ni≥0.9 and % Co≥0.9, then % Si<0.4.

For other application of the invention the elements that mostly remain in solid solution, the most representative being % Mn, % Si and % Ni are very critical. It is desirable to have the sum of all elements exceed 0.8%, preferably exceed 1.2%, more preferably 1.8% and even 2.6%. As can be seen both % Mn and % Si need to be present. % Mn is often present in an amount exceeding 0.4%, preferably 0.6% and even 1.2%. For particular applications, Mn is interesting to be even 1.5%. The case of % Si is even more critical since when present in significant amounts it strongly contributes to the retarding of cementite coarsening. Therefore % Si will often be present in amounts exceeding 0.4%, preferably 0.6% and even 0.8%. When the effect on cementite is pursuit then the contents are even bigger, often exceeding 1.2%, preferably 1.5% and even 1.65%. As can be seen the critical elements for attaining the mechanical properties desired for such applications need to be present and thus it has to be % Si+% Mn+% Ni+% Cr greater than 2%, preferably greater than 2.2%, more preferably greater than 2.6% and even greater than 3.2%. For some applications it is interesting to replace % Cr for % Mo, and then the same limits apply. Alternatively to % Si+% Mn+% Ni+% Mo>2%, the presence of % Mo can be dealt alone when present in an amount exceeding 1.2%, preferably exceeding 1.6%, and even exceeding 2.2%. For the applications where cost is important it is specially advantageous to have the expression % Si+% Mn+% Ni+% Cr replaced by % Si+% Mn and then the same preferential limits can apply, but in presence of other alloying elements, also lower limits can be used like % Si+% Mn>1.1%, preferably 1.4% or even 1.8%. For some applications, % Ni is desirable to be at least 1%. For applications where a predominantly bainitic microstructures is sought, alloying elements with higher propensity than Fe to alloy with % C, % N and % B will be chosen. In this sense, most significant are % Moeq, % V, % Nb, % Zr, % Ta, % Hf, to a lesser extend % Cr and all other carbide formers. Often more than a 4% in the sum of elements with higher affinity for carbon than iron will be present, preferably more than a 6.2%, more preferably more than 7.2% and even more than 8.4%. If primary carbides are not detrimental for the application and cost allows, very strong carbide formers (% Zr+% Hf+% Nb+% Ta) will be used in an amount exceeding 0.1%, preferably 0.3% and even 0.6%. Other elements may be present, especially those with little effect on final properties sought. In general it is expected to have less than 2% of other elements (elements not specifically cited), preferably 1%, more preferably 0.45% and even 0.2%.

Occasionally it is necessary, and even more accurate, to know the chemical composition of a given alloy expressed in atomic percentage (at. %), instead of mass percentage. Under these circumstances, and for certain applications, it is necessary that the sum of iron and manganese content be greater than 65% (Fe+Mn>65%), preferably greater than 75%, more preferably greater than 90% and even greater than 95%. For some other cases, the sum of carbon, boron and silicon content remains below 10% (C+Si+B<10%), preferably must remain below to 9%, more preferably below to 7% and even below 5%. Even for other applications it is preferable that this amount remain below to 3%, more preferably below 2% and even below 1%. For very demanding applications it is desirably that % Nb<1%, preferably above a 0.2%, more preferably above a 0.5% and even above a 0.8%. Moreover, sometimes it is necessary that the sum of chromium, molybdenum and tungsten remains below to 3% (Cr+Mo+W<3%); preferably above a 1%, more preferably above a 2%, and even above a 2.5%. All the aforementioned values and increments being in atomic percentage (at. %).

Although most applications can be distinguished for the content % Ceq, in many other cases it is interesting differentiate these applications through the contents of elements that form the % Ceq; namely C, N and B.

In this regard, for certain applications it is desirable to have a nitrogen content of 10% of the % Ceq, preferably 5%, more preferably 3% and even 2%. Nevertheless in other cases it is interesting to know the numerical value instead the percentage. In this cases it is desirable to have a nitrogen content of 0.45%, preferably above 1%, more preferably above 1.6% or even above 2.2%.

Similarly for the case of B, where is desirable to have a boron content of 10% of the % Ceq, preferably 5%, more preferably 3% and even 2%. Here also it is desirable to have a boron content of 0.25%, preferably 0.7%, more preferably 1.2% or even 2%. For other applications also it is desirable to have a maximum boron content below a 0.25%, preferably below a 0.5%, more preferably below a 0.7% or even below a 2%.

In order to reducing the tooling construction costs the addition of machinability enhancers is also possible. The most commonly used element is sulphur (S), with concentrations below preferably below 1%, more preferably below 0.7% and even more preferably below 0.5%. At the same time, usually the level of Mn is increased to make sure sulphur is present as manganese sulphide (MnS) and not as iron sulphide (FeS) which seriously hinders toughness. Also concentrations below 1% of As, Sb, Bi, Se, Te, and even Ca can be used for this purpose. Other elements may be present, especially those with little effect on final properties sought. In general it is expected to have less than 2% of other elements (elements not specifically cited), preferably 1%, more preferably 0.45% and even 0.2%. A special case is that of Nb, although its effect on toughness is quite negative and thus its presence will be as unavoidable impurity, for some specific applications where grain growth control is desirable, it can be used, with contents up to 2%.

The iron-based alloy powders of the present invention are obtained through a powder metallurgy processes; precisely through the centrifugal disk atomization technique. The powder obtained, under certain conditions and as a result of the application of the technique previously described, is appropriate for applications of powder compaction and sintering (hot, warm and cold compaction) such as near-fully or fully dense process, namely; either Hot Isostatic Pressing (HIP), powder forging, extrusion, metal injection molding, thermal spray, spray forming, cold spray to name a few of them. For applications that not requiring spherical or near-spherical particle morphologies, the powder produced is also suitable to the use for cold compaction through techniques such as Cold Isostatic Pressing (CIP, room temperature) or similar techniques.

The inventors have realized that to have particularly acceptable or good powder properties, when it comes to pressing and sintering of the powder, is advantageous to use the powder of the present invention with a minimum particle size normally below to 250 μm, preferably below to 150 μm, more preferably to have below to 100 μm and even below to 60 μm. For some applications, i.e. big shapes and billet production, it is necessary to have a minimum powder size of 120 μm or above, preferably 280 μm or above, more preferably 420 μm or above or even higher than 600 μm.

The alloys of the present invention also are suitable for applications involving layer or additive manufacturing, solid-free form fabrication, digital manufacturing or e-manufacturing such as, rapid manufacturing/prototyping (RM/P), 3-D printing, laser forming, fused deposition model-ling, laminated object manufacturing, Selective Laser Sintering (SLS), Selective Laser Melting (SLM) and 3-D laser cladding, among other similar techniques. Also laser, plasma or electron beam welding can be conducted using powder or wire made of alloys of the present invention. In addition, the inventors have realized that to have particularly acceptable or good powder properties (such as apparent and sintered density, flowability, sinterability, compressibility, etc.), when it comes to the application of powder to the additive manufacturing techniques, is advantageous to use the powder of the present invention with a minimum particle size often below to 75 μm, preferably below to 50 μm, more preferably below to 20 μm and even below to 15 μm. In this sense, the surface roughness of the finished part is mostly influenced by the powder particle size and, according to this, the smaller particle sizes promote the higher surface qualities. For some applications, for example, where surface quality is not a critical parameter, it is acceptable to have a minimum powder size of 40 μm or above, preferably 55 μm or above, more preferably 80 μm or above or even higher than 100 μm.

The iron-based alloys can be directly obtained with the desired shape, as mentioned above, or can be improved by other metallurgical processes. The use of the iron-based powder produced by the method according to the present invention can involve thermal or heat treatments; such as tempering and even quenching. Forging or rolling are frequently used to increase toughness, even three-dimensional forging of blocks.

According to the tool steel alloys of the present invention, it can be obtained in any shape, for example in the form of bar, wire or powder (amongst others to be used as solder or welding alloy). The iron-based alloys of the present invention could also be used with a thermal spraying technique to apply in parts of the surface of another material. Obviously the alloys of the present invention can be used as part of a composite material, for example when embedded as a separate phase, or obtained as one of the phases in a multiphase material. Also when used as a matrix in which other phases or particles are embedded whatever the method of conducting the mixture (for instance, mechanical mixing, attrition, projection with two or more hoppers of different materials . . . ). Moreover, the iron-based alloys of the present invention are suitable for applications where the resistance to the working environment is focused on the corrosion or oxidation resistance than wear resistance, although both often co-exist. In such cases oxidation resistance at the working temperature or corrosion resistance against the aggressive agent are desirable. For such applications corrosion resistance tool steels are often employed, at different hardness levels and with different wear resistances depending on the application. The alloys of the present invention can also be a part of a functionally graded material, in this sense any protective layer or localized treatments can be used. The most typical ones being layers or surface treatments:

- To improve tribological performance: surface hardening (laser, induction . . . ), surface treatments (nitriding, carburizing, borurizing, sulfidizing, any mixtures of the previous . . . ), coatings (CVD (Chemical Vapor Deposition), PVD (Physical Vapor Deposition), fluidized bed, thermal projection, cold spray, cladding . . . ).
- To increase corrosion resistance: hard chromium, palladium, chemical nickel treatment, sol gel with corrosion resistant resins, in fact any electrolytic or non-electrolytic treatment providing corrosion or oxidation protection.
- Any other functional layer also when the function is appearance.

Especially, the tool steel alloys of the present invention can also be used for the manufacturing of parts requiring a high working hardness (for example due to high mechanical loading or wear) which require some kind of shape transformation from the original steel format. As an example: dies for forging (open or closed die), extrusion, rolling. The present invention is especially indicated for the manufacture of dies for the hot stamping or hot pressing of sheets. Likewise, dies for plastic forming of thermoplastics and thermosets in all of its forms and also dies for forming or cutting.

The alloys described above can be also applied for tooling applications, in which excellent mechanical properties, combined with higher fabricability (minimum distortion during age hardening and lack of decarburization issues), are important; e.g., the manufacturing of high precision plastic injection tools, with excellent mechanical resistance and toughness. Particular applications of some of the iron-based alloys of the present invention also include fabrication of components subject to impact fatigue, with an adequate wear resistance, resistance corrosion and applications requiring nitriding, ceramic coatings surface treatments and finely polished surfaces.

Additional embodiments of the invention are described in the dependent claims.

The technical features of all the embodiments herein described can be combined with each other in any combination.

EXAMPLES

In the following, some examples indicate the way in which several iron-based alloy compositions of the present invention can be manufactured through the centrifugal atomization in order to obtain metallic powder of the desired characteristics. All the experimental runs were made in the apparatus used for making metal powder using a rotating atomization means as set forth herein and under a protective atmosphere, unless otherwise noted. The centrifugal atomization of the molten metal breaks a melt stream into small droplets, which subsequently cooled rapidly by convection through the atomization atmosphere. Thereafter, the metallic powder was collected and sieved under the standard procedure for metallographic characterization. The obtained results of three experimental runs, together to the chemical compositions of the atomized alloys and the atomization parameters employed, are set forth below.

Example 1

An iron-based alloy, with the chemical composition according to TABLE 1, ID 1, was selected and using the following parameters of atomization, a sample of metallic powder was prepared: atomization temperature 1,660° C., feed rate of molten metal of 120 $kg \cdot h^{-1}$, a flat disk (tungsten) with a diameter of 50 mm, operating at a rotational speed of 20,000 rpm (approximately 2,095 $rad^{-1}$). The distance from the nozzle to the disk was set at 0.06 m and the atomization run was carried in air atmosphere. FIG. 1 shows a SEM micrograph of the centrifugally atomized powder obtained under the described atomization parameters.

The mean particle size obtained was 125 m with a log-normal size distribution.

Example 2

An iron-based alloy, with the chemical composition according to TABLE 2, ID 48, was selected and using the following parameters of atomization, a sample of metallic powder was prepared: atomization temperature 1,690° C., feed rate of molten metal of 95 $kg \cdot h^{-1}$, a cup disk (tungsten) with a diameter of 40 mm, operating at a rotational speed ranging between 17,500 rpm and 19,000 rpm (approximately between 1,830 $rad^{-1}$ and 1,990 $rad^{-1}$). In this case, the distance from the nozzle to the disk was set at 0.08 m.

In this case, the mean particle size obtained was 180 μm with a log-normal size distribution.

Example 3

Figure 4:
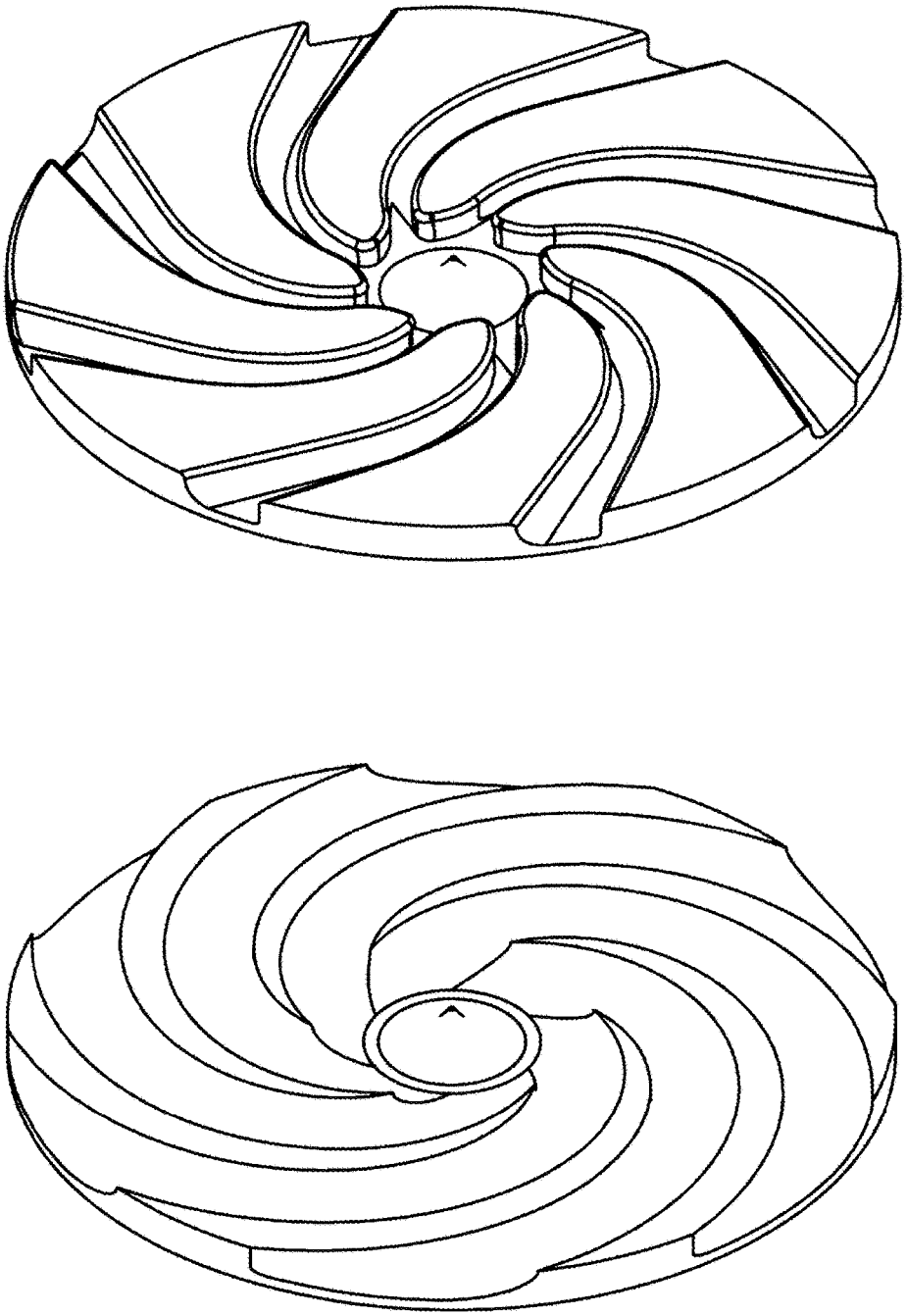
FIG. 4: Atomizing rotating element of the invention is a second embodiment.

The following Table 1 has been checked for the proper atomization of fine (<100 m) spherical or quasi spherical powder in a rotatory element according to FIG. 4, in an atmosphere of Ar.

TABLE 1

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 1 | 1.79 | | | | 0.32 | 0.42 | 4.1 | | 6.38 | 12.3 | 4.9 | | | | | | | | | | | |
| 2 | 1.2 | | | | 1.34 | 0.36 | 7.7 | 0.077 | 1.8 | 1.15 | 2.5 | | | | 0.023 | | | 0.018 | | | | |
| 3 | 1.79 | | | 1.79 | 0.42 | 0.46 | 4.11 | | 6.62 | 12.07 | 4.87 | | | | | | | | | | | |
| 4 | 0.85 | | | 0.85 | 1.3 | 0.21 | 4.25 | | 1.6 | 0.7 | 3.4 | 0.4 | | | | | | | | | | |
| 5 | 0.5 | | | 0.5 | 0.3 | 0.31 | 3.25 | | 1.4 | | | | | | | | | | | | | |
| 6 | 1.1 | | | 1.1 | 1.2 | 0.4 | 4 | 0 | 1.3 | 0.3 | 3.7 | | | 0 | 0.02 | 0 | 0 | 0.02 | | | | |
| 7 | 0.9 | | | 0.9 | 1.2 | 0.4 | 4 | 0 | 1.3 | 0.3 | 3.3 | | | 0 | 0 | 0 | 0 | 0 | | | | |
| 8 | 1.2 | | | 1.2 | 1.22 | 0.37 | 7.6 | | 0.89 | 0.27 | 3.7 | | | 0 | 0.01 | | 0 | 0.01 | | | | |
| 9 | 1.2 | | | 1.2 | 1.34 | 0.36 | 7.7 | 0.077 | 1.8 | 1.15 | 2.5 | | | | 0.023 | | | 0.018 | | | | |
| 10 | 1.1 | | | 1.1 | 1.3 | 0.35 | 4.25 | | 1.6 | 0.9 | 2.9 | | | | | | | | | | | |
| 11 | 1.15 | | | 1.15 | 1.35 | 0 | 4.4 | | 1.5 | 0.75 | 2.85 | | | | | | | | | | | |
| 12 | 1.18 | | | 1.18 | | | 8.24 | | 1.15 | 1.39 | 2.8 | | | | | | | | | | | |
| 13 | 1.27 | | | 1.27 | | | 4.2 | | 5 | 6.4 | 3.1 | | | | | | | | | | | |
| 14 | 0.38 | | | 0.38 | 1.05 | 0.4 | 5.2 | | 1.25 | | 0.4 | | | | | | | | | 0.03 | 0.03 | |
| 15 | 0.38 | | | 0.38 | 1.05 | 0.4 | 5.2 | | 1.25 | | 0.4 | | | | | | | | | | | |
| 16 | 0.4 | | | 0.4 | 1 | 0.4 | 5.25 | | 1.35 | | 1 | | | | | | | | | 0.02 | 0.002 | |
| 17 | 0.4 | | | 0.4 | 1 | 0.4 | 5.25 | | 1.35 | | 1 | | | | | | | | | | | |
| 18 | 1.2 | | | 1.2 | 1.34 | 0.36 | 7.7 | 0.077 | 1.8 | 1.15 | 2.5 | | | | 0.023 | | | 0.018 | | | | |
| 19 | 0.4 | | | 0.4 | 1 | 0.4 | 5.25 | | 1.35 | | 1 | | | | | | | | | | | |
| 20 | 0.4 | | | 0.4 | 0.4 | 1.5 | 2 | | 0.2 | | | | | | | | | | | 0.035 | 0.035 | |
| 21 | 0.4 | | | 0.4 | 0.3 | 1.5 | 2 | 1 | 0.2 | | 0.05 | | | | | | | | | 0.035 | 0.035 | |
| 22 | 0.4 | | | 0.4 | 0.4 | 1.5 | 2 | | 0.2 | | | | | | | | | | | 0.07 | 0.03 | |
| 23 | 0.32 | | | 0.32 | 0.25 | 0.3 | 3 | | 2.8 | | 0.5 | | | | | | | | | | | |
| 24 | 0.38 | | | 0.38 | 0.4 | 0.45 | 5 | | 3 | | 0.55 | | | | | | | | | 0.025 | 0.005 | |
| 25 | 1.33 | | | 1.33 | 0.32 | 0.27 | 4.25 | | 4.9 | 6 | 4.15 | | | | | | | | | | | |
| 26 | 0.5 | 0.015 | | 0.5129 | 1.3 | 0.3 | 3.7 | 6 | 1.6 | 0.15 | 1.8 | | | | | 2.7 | | 0.01 | | | | |
| 27 | 0.34 | | | 0.34 | 0.03 | 0.2 | 2.04 | | 4 | 3.3 | 0.016 | | | | | | | | | | | 0 |
| 28 | 0.33 | | | 0.33 | 0.03 | 0.2 | 2.9 | | 3.9 | 3.2 | 0.015 | | | | | | | | | | | 0 |
| 29 | 0.33 | | | 0.33 | 0.22 | 0.24 | 2.07 | | 4.3 | 0 | 0 | | | | | | | | | | | 0 |
| 30 | 0.32 | | | 0.32 | 0.22 | 0.24 | 3 | | 4.2 | 0 | 0 | | | | | | | | | | | 0.000999 |
| 31 | 0.42 | | | 0.42 | 0 | 0 | 2.2 | | 3.45 | 1.4 | 0.6 | 0.2 | 0.3 | | | | | | | | | 0.00999 |
| 32 | 0.32 | | | 0.32 | | 0 | 2.66 | | 3.36 | 1.52 | 0.45 | | | | | | | | | | | |
| 33 | 0.4 | | | 0.4 | 1.4 | 1.53 | 2.1 | | 0.09 | 0.27 | 0.05 | | | | | | | | | | | |
| 34 | 1.02 | | | 1.02 | 1.12 | 0.28 | 8.01 | | 1.78 | 0.92 | 2.4 | | | | | | | | | | | |
| 35 | 1.23 | | | 1.23 | 0 | 0.21 | 2.01 | | 3.8 | 11.2 | 3.4 | | | | | | | | | | | |
| 36 | 0.98 | | | 0.98 | | | 8.01 | | 2.66 | 1.26 | 2.02 | | | | | | | | | | | |
| 37 | 0.45 | | | 0.45 | 0.25 | 0.41 | 4.21 | | 3.39 | 1.54 | 0.85 | | | | | | | | | | | |
| 38 | 0.61 | | | 0.61 | 0.32 | 0.32 | 5.08 | | 3.34 | 1.65 | 0.52 | | | | | | | | | | | |
| 39 | 0.4 | | | 0.4 | 0.11 | 0.14 | 8.2 | | 1.15 | 0.02 | 0.87 | | | | | | | | | | | |
| 40 | | | | 0.52 | 0.82 | 0.14 | 3.52 | 5.7 | 1.4 | 0.78 | 1.74 | 0.28 | 0 | | 0.3 | 2.08 | 0.5 | | | | | |
| 41 | | | | 0.49 | 1.12 | 0.35 | 3.66 | 5.9 | 1.79 | 0 | 2 | 0 | 0 | | 0 | 2.3 | 2 | | | | | |
| 42 | 0.388 | | | 0.388 | 1.43 | 1.53 | 2.08 | 0.05 | 0.09 | 0 | 0.05 | | | | | | | | | | | |
| 43 | | | | 0.5 | 1.3 | 0.3 | 3.7 | 6 | 1.6 | 0.15 | 1.8 | 0 | 0 | | 0 | 2.7 | 0 | | | | | |
| 44 | | | | 0.3 | 0.1 | 0.4 | 5 | 5 | 1 | 0 | | 0 | 0 | | | | 0 | | | | | |
| 45 | | | | 0.45 | 0.05 | 0.08 | 2 | 3 | 0 | 0 | 1 | | | | | 0.5 | | 0 | | | | |
| 46 | | | | 0.55 | 1.5 | 2 | 5 | 6 | 3 | 2 | 3.5 | | | | | 2 | | 4 | | | | |
| 47 | | | | 0.8 | 0.05 | 0.08 | 2 | 5 | 1 | 1 | 2 | 0 | 0 | | 0 | 1.5 | 0.3 | 0 | | | | |

For compositions 15 to 20, 26, 33, the elements H, He, Be, O, F, Ne, Mg, Cl, Ar, K, Ca, Sc, Zn, Ga, Ge, As, Se, Br, Kr, Rb, Sr, Y, Tc, Ru, Rh, Pd, Ag, Cd, In, Sn, Sb, Te, I, Xe, Cs, Ba, La, Ce, Pr, Nd, Pm, Sm, Eu, Gd, Tb, Dy, Ho, Er, Tm, Yb, Lu, Re, Os, Ir, Pt, Au, Hg, Tl, Pb, Bi, Po, At, Rn, Fr, Ra, Ac, Th, Pa, U, Np, Pu, Am, Cm, Bk, Cf, Es, Fm, Md, No, Lr, Rf, Db, Sg, Bh, Hs, Mt are <0.01% (otherwise indicated in the table).

Example 4

Figure 3:
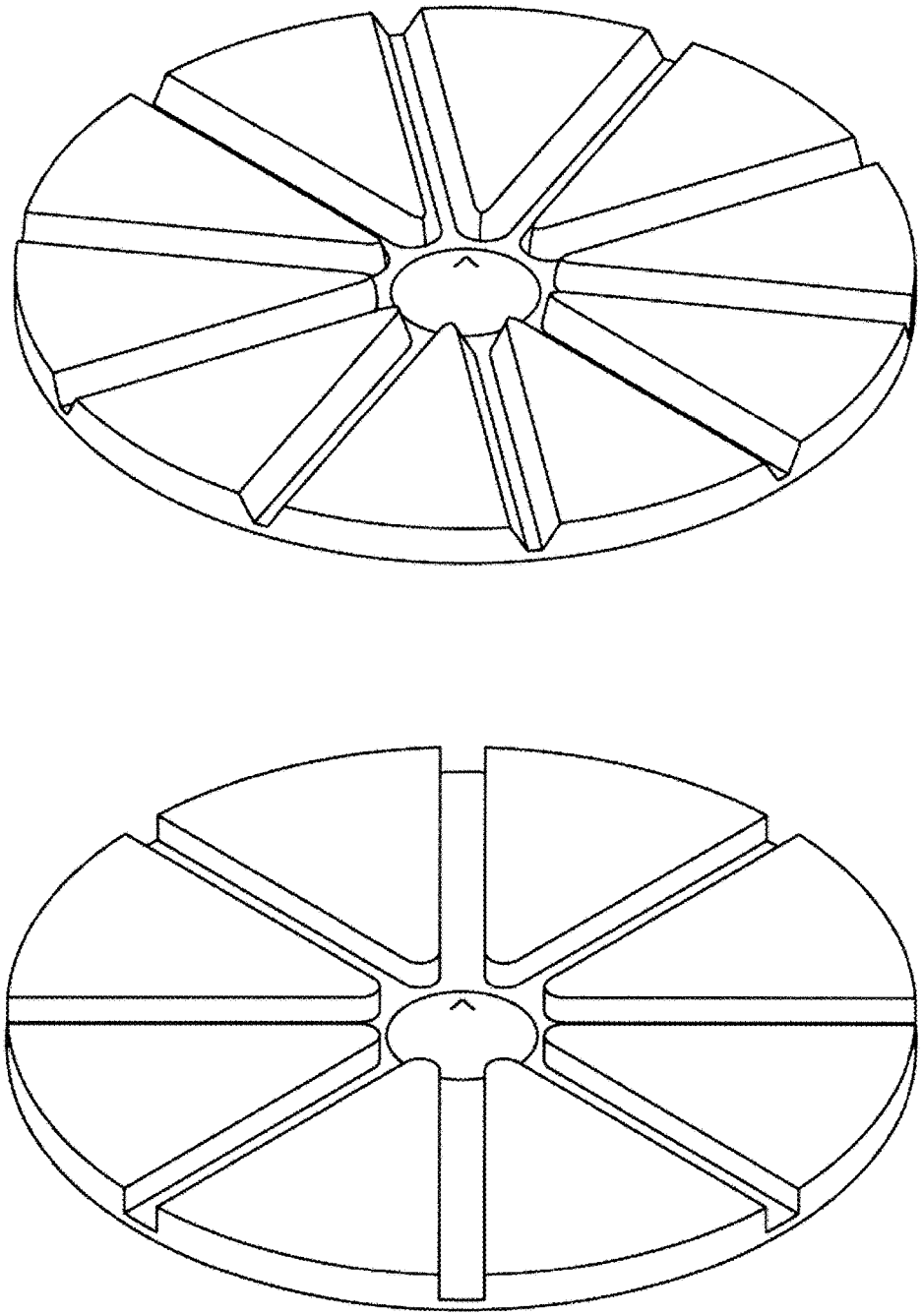
FIG. 3: Atomizing rotating element of the invention in a first embodiment.

The following Table 2 has been checked for the proper atomization of fine (<100 m) spherical or quasi spherical powder in a rotatory element according to FIG. 3, in an atmosphere of Ar. The following rules have been observed:

When % Cr<2 then % Mo+% W+% V+% Ti>0.5

TABLE 2

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 48 | 0.73 | | | | | 0.18 | 0.3 | 0.39 | 6.12 | | 3.7 | | | | | | | 0.25 | | | | |
| 49 | 0.35 | | | 0.35 | 0.13 | 0.27 | 0.015 | | 3.3 | 1.7 | 0.61 | | | 0.05 | 0.02 | | 0.01 | 0.01 | | | | |
| 50 | 0.57 | | | 0.57 | 0.26 | 0.71 | 1.08 | 1.62 | 0.48 | | 1.12 | | | | | | | | | | | |
| 51 | 0.32 | | | 0.32 | 0.3 | 0.25 | 0.2 | 0.2 | 3.23 | 1.85 | 0.1 | | | 0.1 | 0.2 | 0.04 | 0.02 | 0.3 | | | | |
| 52 | 0.32 | | | 0.32 | 0.1 | 0.4 | 0.1 | 3.7 | 3.2 | 2.2 | | | | | | | | | | | | |
| 53 | 0.37 | | | 0.37 | | 0.22 | 0.061 | | 3.9 | 2.9 | | | | 0.037 | 0.02 | | 0.01 | 0.01 | | | | |
| 54 | 0.75 | | | 0.75 | 0.3 | 0.18 | 0.01 | 0.41 | 6.22 | 3.59 | | | | 0.01 | 0.01 | | 0.01 | 0.25 | | | | |
| 55 | 0.5 | | | 0.5 | | | | | 3.6 | 1.4 | 0.5 | 0.11 | 0.14 | 0.07 | | | | | | | | |
| 56 | 0.9 | | | 0.9 | 0.25 | 1.25 | 0.5 | | | 0.5 | | | | | | | | | | | | |
| 57 | 0.55 | | | 0.55 | 0.25 | 0.8 | 1.1 | 1.65 | 0.5 | | 0.1 | | | | | | | | | | | |
| 58 | 0.56 | | | 0.56 | 0.25 | 0.8 | 1.1 | 1.7 | 0.5 | | 0.1 | | | | | | | | | | | |
| 59 | 0.49 | 0.027 | 0.001 | 0.51442 | | 0.3 | 1.3 | 6.5 | 2.6 | 0.31 | 3.2 | 0.24 | | 0.01 | 0.01 | 2.6 | 0.33 | 0.02 | | 0.008 | 0.005 | 0.047 |
| 60 | 0.27 | | | 0.27 | | | | | 3.3 | 0.6 | | | | | | | | | | 0.12 | | |
| 61 | 0.35 | | | 0.35 | 0.03 | 0.2 | 0.03 | | 4 | 3.3 | 0.016 | | 0 | | | | | | | | | 0 |
| 62 | 0.34 | | | 0.34 | 0.03 | 0.2 | 0.4 | | 4 | 3.3 | 0.016 | | 0 | | | | | | | | | 0 |
| 63 | 0.34 | | | 0.34 | 0.03 | 0.2 | 1.01 | | 4 | 3.3 | 0.016 | | 0 | | | | | | | | | 0 |
| 64 | 0.34 | | | 0.34 | 0.03 | 0.2 | 1.4 | | 4 | 3.3 | 0.016 | | 0 | | | | | | | | | 0 |
| 65 | 0.33 | | | 0.33 | 0.22 | 0.24 | 0.02 | | 4.3 | 0 | 0 | | 0 | | | | | | | | | 0 |
| 66 | 0.33 | | | 0.33 | 0.22 | 0.24 | 0.6 | | 4.3 | 0 | 0 | | 0 | | | | | | | | | 0 |
| 67 | 0.33 | | | 0.33 | 0.22 | 0.24 | 1.64 | | 4.3 | 0 | 0 | | | | | | | | | | | 0 |
| 68 | 0.32 | | | 0.32 | 0.04 | 0.2 | 0.02 | | 3.8 | 3 | 0.009 | | | | | | | | | | | 0.001 |
| 69 | 0.29 | | | 0.29 | 0.1 | 0.27 | 0.02 | | 3.1 | 2.1 | 0 | | | | | | | | | | | 0.001 |
| 70 | 0.27 | | | 0.27 | 0.2 | 0.25 | 0.02 | | 2.18 | 4.1 | 0 | | 0 | | | | | | | | | 0.003 |
| 71 | 0.35 | | | 0.35 | 0.13 | 0.27 | 0.015 | | 3.3 | 1.7 | 0.61 | | | | | | | | | | | 0.003 |
| 72 | 0.28 | | | 0.28 | 0.16 | 0.26 | 0.02 | | 2.58 | 3 | 0 | | 0 | | | | | | | | | 0.00319 |
| 73 | 0.3 | | | 0.3 | 0.05 | 0.2 | 0.01 | | 4 | 1.1 | 0 | | 0 | | | | | | | | | 0.00327 |
| 74 | 0.37 | | | 0.37 | 1.2 | 0.24 | 0.8 | | 4.5 | 1.5 | 0 | | 0 | | | | | | | | | 0.0033 |
| 75 | 0.5 | | | 0.5 | 0.04 | 0.3 | 0 | | 6.7 | 4 | 0 | | 0 | | | | | | | | | 0.0033 |
| 76 | 0.32 | | | 0.32 | 0.04 | 0.2 | 0.02 | | 3.8 | 3 | 0.009 | | 0 | | | | | | | | | 0.00342 |
| 77 | 0.5 | | | 0.5 | 0.03 | 0.2 | 0.03 | | 9 | 0.1 | 0 | | 0 | | | | | | | | | 0.00342 |
| 78 | 0.31 | | | 0.31 | 0.12 | 0.19 | 0.05 | 3.2 | 3.2 | 1.9 | | | | | | | | | | | | 0.00377 |
| 79 | 0.32 | | | 0.32 | 0.15 | 0.23 | 0.07 | 3.4 | | 1.9 | | | | | | | | | | | | 0.00377 |
| 80 | 0.345 | | | 0.345 | 0.05 | 0.2 | 0.05 | 3.1 | 4.4 | 3.4 | | | | | | | | | | | | 0.00377 |
| 81 | 0.357 | | | 0.357 | 0.11 | 0.21 | 0.07 | 3.4 | 4.6 | 3.5 | | | | | | | | | | | | 0.00383 |
| 82 | 0.74 | | | 0.74 | 0.045 | 0.21 | 0.04 | 3.5 | 10 | 8 | | | | | | | | | | | | 0.00383 |
| 83 | 0.4 | | | 0.4 | 0 | 0 | 0 | | 3.6 | 1.4 | 0.3 | | | | | | | | | | | 0.0039 |
| 84 | 0.45 | | | 0.45 | 0 | 0 | 0 | | 1.6 | 4.5 | 0.4 | | | | | | | | | | | 0.00999 |
| 85 | 0.41 | | | 0.41 | 0 | 0 | 1.3 | | 3.5 | 1.4 | 0.8 | | | | | | | | | | | 0.00999 |
| 86 | 0.5 | | | 0.5 | 0 | 0 | 0 | | 3.6 | 1.4 | 0.5 | | | | | | | | | | | 0.00999 |
| 87 | 0.33 | | 0.16 | 0.522 | 0 | 0.4 | 0 | | 3.36 | 1.91 | 0 | 0.16 | 0.16 | 0.16 | | | | | | | | 0.00999 |
| 88 | 0.36 | | | 0.36 | 0 | 0 | 0 | | 3.67 | 1.33 | 0.46 | 0.25 | 0.25 | 0.25 | | | | | | | | 0.00999 |
| 89 | 0.36 | | | 0.36 | 0 | 0 | 0 | | 3.75 | 1.34 | 0.5 | 0.28 | 0.28 | 0.28 | | | | | | | | 0.00999 |
| 90 | 0.32 | | | 0.32 | 0 | 0 | 0 | | 3.67 | | 0.23 | 0.22 | 0.42 | | | | | | | | | 0.0506 |
| 91 | 0.33 | | | 0.33 | 0 | 0 | 0 | | 3.8 | 1.22 | 0.4 | | | | | | | | | | | |
| 92 | 0.38 | | | 0.38 | 0 | 0 | 0 | | 3.74 | 1.36 | 0.02 | 0.55 | 0.55 | 0.55 | | | | | | | | |
| 93 | 0.36 | | | 0.36 | 0 | 0 | 0 | | 3.66 | 1.26 | 0.01 | 0.44 | 0.44 | 0.44 | | | | | | | | |
| 94 | 0.6 | | | 0.6 | 0.14 | 0.54 | 0 | | 3.6 | 1.2 | 0.62 | | | | | | | | | | | |
| 95 | 0.85 | | | 0.85 | 0.2 | 0.22 | 0.02 | | 6.48 | 4 | 0 | | | | | | | | | | | |

TABLE 2-continued

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 96 | 0.79 | | | 0.79 | 0.1 | 0.1 | 0 | | 6.42 | 3.78 | 0.41 | | | | | | | | | | | |
| 97 | 0.45 | | | 0.45 | 0.45 | 0 | 0 | | 3.87 | 1.67 | 0.49 | | | | | | | | | | | |
| 98 | 0.37 | | | 0.37 | 0 | 0 | 0 | | 3.3 | 1.01 | 0 | 2.9 | 2.9 | 2.9 | | | | | | | | |
| 99 | 0.31 | | | 0.31 | 0 | 0.16 | 0 | | 3.08 | 0.86 | 0 | 2.3 | 2.3 | 2.3 | | | | | | | | |
| 100 | 0.5 | | | 0.5 | 0.1 | 0 | 0 | | 3.65 | 1.27 | 0.45 | | | | | 0.7 | | | | | | |
| 101 | 0.5 | | | 0.5 | 0.8 | 0 | 0 | | 3.73 | 1.52 | 0.17 | | | | | | | | | | | |
| 102 | 0.53 | | | 0.53 | 0 | 0.6 | 0 | | 3.61 | 1.35 | 0.44 | | | | | 0.8 | | | | | | |
| 103 | 0.59 | | | 0.59 | 0 | 0 | 0 | | 6.7 | 4.6 | 0 | | | | | | | | | | | |
| 104 | 0.69 | | | 0.69 | 0 | 0 | 0 | | 7.89 | 3.95 | 0.7 | | | | | | | | | | | |
| 105 | 0.62 | | | 0.62 | 0 | 0 | 0 | 0.28 | 8.01 | 3.75 | 0.1 | | | | | | | | | | | |
| 106 | 0.75 | | | 0.75 | 0 | 0 | 0 | | 6.11 | 3.4 | 0.5 | 0.14 | 0.28 | | | | | | | | | |
| 107 | 0.87 | | | 0.87 | 0 | 0 | 0 | | 6.92 | 4.4 | 0.7 | 0.15 | 0.23 | | | | | | | | | |
| 108 | 0.38 | | | 0.38 | 1.5 | 1.56 | 0 | | 0.05 | 0.26 | 0.4 | | | | | | | | | | | |
| 109 | 0.27 | | | 0.27 | 0 | 0 | 0 | 3.5 | 3.76 | 1.39 | 0.5 | 3.5 | 3.5 | | | | | | | | | |
| 110 | 0.37 | | | 0.37 | 0 | 0 | 0 | 2.8 | 3.46 | 1.01 | 0 | | | | | | | | | | | |
| 111 | 0.33 | | | 0.33 | 0.1 | 0 | 1.06 | | 3.8 | 1.22 | 0.4 | | | | | | | | | | | |
| 112 | 0.38 | | | 0.38 | 0 | 0 | 0 | | 3.74 | 1.36 | 0.02 | | | | | | | | | | | |
| 113 | 0.322 | | | 0.322 | 0 | 0.144 | 0.071 | 3.01 | 3.01 | 1.93 | 0.017 | | | | | | | | | | | |
| 114 | 0.384 | | | 0.384 | 0.088 | 0.158 | 0.074 | 3.08 | 3.08 | 2.13 | 0.016 | | | | | | | | | | | |
| 115 | 0.31 | | | 0.31 | 0.02 | 0.02 | 0.01 | 1.86 | 3.7 | 2.3 | 0 | | | | | | | | | | | |
| 116 | 0.37 | | | 0.37 | 0.02 | 0.11 | 0.01 | 2.05 | 3.9 | 2 | 0 | | | | | | | | | | | |
| 117 | 0.39 | | | 0.39 | 0.05 | 0.02 | 0.01 | 0.84 | 3.71 | 1.2 | 0.6 | | | | | | | | | | | |
| 118 | 0.21 | | | 0.21 | 0.04 | 0.21 | 0.01 | | 3.2 | 1.04 | 0.3 | | | | | | | | | | | |
| 119 | 0.294 | | | 0.294 | 0.213 | 0.111 | 0.053 | | 3.29 | 1.44 | 0 | | | | | | | | | | | |
| 120 | 0.322 | | | 0.322 | 0 | 0.144 | 0.071 | 3.01 | 3.01 | 1.93 | 0.017 | | | | | | | | | | | |
| 121 | 0.31 | | | 0.31 | 0.02 | 0.02 | 0.01 | 1.86 | 3.7 | 2.3 | 0 | | | | | | | | | | | |
| 122 | 0.37 | | | 0.37 | 0.02 | 0.11 | 0.01 | 2.05 | 3.9 | 2 | 0 | | | | | | | | | | | |
| 123 | 0.4 | | | 0.4 | 0 | 0 | 0 | | 3.6 | 1.4 | 0.3 | | | | | | | | | | | |
| 124 | 0.32 | | | 0.32 | 0 | 0.4 | 0 | | 3.36 | 1.91 | 0.22 | | | | | | | | | | | |
| 125 | 0.33 | | | 0.33 | 0 | 0 | 0 | | 3.8 | 1.22 | 0.4 | | | | | | | | | | | |
| 126 | 0.36 | | | 0.36 | 0 | 0 | 0 | | 3.66 | 1.26 | 0.02 | 0.5 | | | | | | | | | | |
| 127 | 0.31 | | | 0.31 | 0 | 0 | 0 | | 3.36 | 1.52 | 0.45 | | | | | | | | | | | |
| 128 | 0.36 | | | 0.36 | 0.1 | 0.47 | 1.12 | | 3.75 | 1.91 | 0.44 | | | | | | | | | | | |
| 129 | 0.32 | | | 0.32 | 0 | 0 | 0 | | 3.36 | 1.11 | 0 | | | | | | | | | | | |
| 130 | 0.6 | | | 0.6 | 0.14 | 0.54 | 0 | | 3.6 | 1.2 | 0.62 | | | | | | | | | | | |
| 131 | 0.72 | | | 0.72 | 0 | 0 | 0 | | 3.75 | 2 | 0.54 | | | | | | | | | | | |
| 132 | 0.34 | | | 0.34 | 0 | 0 | 0 | 2.6 | 1.6 | 4.5 | 0.1 | | | | | | | | | | | |
| 133 | 0.31 | | | 0.31 | 0 | 0 | 0 | 0.8 | 3.2 | 0.8 | 0 | | | | | | | | | | | |
| 134 | 0.17 | | | 0.17 | 0.2 | 0.36 | 0 | | 3.3 | 1.1 | 0.1 | | | | | | | | | | | |
| 135 | 0.29 | | | 0.29 | 0.04 | 0.022 | 0.019 | | 3.36 | 0.1 | 0.002 | | | | | | | | | | | |
| 136 | 0.28 | | | 0.28 | 0.04 | 0.025 | 0.02 | | 3.59 | 0.6 | 0.003 | | | | | | | | | | | |
| 137 | 0.28 | | | 0.28 | 0.04 | 0.025 | 0.01 | | 3.7 | 1.19 | 0 | | | | | | | | | | | |
| 138 | 0.28 | | | 0.28 | 0.04 | 0.025 | 0.01 | | 3.7 | 1.19 | 0.004999 | | | | | | | | | | | |
| 139 | 0.39 | | | 0.39 | 0.05 | 0.02 | 0.01 | 0.84 | 3.71 | 1.2 | 0.6 | | | | | | | | | | | |
| 140 | 0.27 | | | 0.27 | 0.05 | 0.02 | 0.01 | | 3.4 | 1.08 | 0 | | | | | | | | | | | |
| 141 | 0.27 | | | 0.27 | 0.05 | 0.02 | 0.01 | | 3.4 | 1.08 | 0.004999 | | | | | | | | | | | |
| 142 | 0.29 | | | 0.29 | 0.05 | 0.019 | 0.01 | | 3.7 | 1.01 | 0.005 | | | | | | | | | | | |
| 143 | 0.33 | | | 0.33 | 0.05 | 0.24 | 0.01 | | 3.39 | 1.11 | 0.43 | | | | | | | | | | | |
| 144 | 0.32 | | | 0.32 | 0.05 | 0.12 | 0.01 | 2.04 | 3.36 | 1.15 | 0.44 | | | | | | | | | | | |
| 145 | 0.29 | | | 0.29 | 0.05 | 0.02 | 0.01 | | 3.62 | 1.18 | 0.004 | | | | | | | | | | | |

TABLE 2-continued

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 146 | 0.33 | | | 0.33 | 0.05 | 0.14 | 0.01 | 3.09 | 3.58 | 1.27 | 0 | | | | | | | | | | | |
| 147 | 0.41 | | | 0.41 | 0.07 | 0.14 | 0.01 | | 3.58 | 1.16 | 0.65 | | | | | | | | | | | |
| 148 | 0.33 | | | 0.33 | 0.05 | 0.26 | 0.01 | | 3.64 | 1.1 | 0.46 | | | | | | | | | | | |
| 149 | 0.33 | | | 0.33 | 0.05 | 0.26 | 0.01 | | 3.7 | 1.36 | 0.43 | | | | | | | | | | | |
| 150 | 0.21 | | | 0.21 | 0.04 | 0.21 | 0.01 | | 3.2 | 1.04 | 0.3 | | | | | | | | | | | |
| 151 | 0.31 | | | 0.31 | 0.02 | 0.02 | 0.01 | 1.86 | 3.7 | 2.3 | 0 | | | | | | | | | | | |
| 152 | 0.37 | | | 0.37 | 0.02 | 0.11 | 0.01 | 2.05 | 3.9 | 2 | 0 | | | | | | | | | | | |
| 153 | 0.32 | | | 0.32 | 0.04 | 0.09 | 0.01 | 2.96 | 3.1 | 1.68 | 0 | | | | | | | | | | | |
| 154 | 0.29 | | | 0.29 | 0.03 | 0.015 | 0.01 | | 3.6 | 1.09 | 0 | | | | | | | | | | | |
| 155 | 0.39 | | | 0.39 | | 0 | 0 | | 3.57 | 1.35 | 0.44 | | | | | | | | | | | |
| 156 | 0.32 | | | 0.32 | 0.1 | 0.17 | 0.1 | 0.017 | 3.1 | 1.7 | 0.03 | | | | | | | | | | | |
| 157 | 0.356 | | | 0.356 | 0 | 0.058 | 0 | 0.47 | 3.9 | 1.4 | 0.484 | | | | | | | | | | | |
| 158 | 0.353 | | | 0.353 | 0 | 0.061 | 0 | 0.481 | 3.81 | 1.41 | 0.461 | | | | | | | | | | | |
| 159 | 0.326 | | | 0.326 | 0 | 0.055 | 0.0108 | 0.488 | 3.68 | 1.49 | 0.44 | | | | | | | | | | | |
| 160 | 0.464 | | | 0.464 | 0 | 0.055 | 0 | 0.516 | 3.89 | 1.67 | 0.452 | | | | | | | | | | | |
| 161 | 0.299 | | | 0.299 | 0 | 0.051 | 0 | 0.95 | 3.77 | 1.31 | 0.452 | | | | | | | | | | | |
| 162 | 0.404 | | | 0.404 | 0 | 0.061 | 0 | 0.969 | 0.38 | 2.46 | 0.457 | | | | | | | | | | | |
| 163 | 0.377 | | | 0.377 | 0 | 0.059 | 0 | 1.01 | 3.81 | 1.35 | 0.473 | | | | | | | | | | | |
| 164 | 0.345 | | | 0.345 | 0 | 0.054 | 0.012 | 1.41 | 3.889 | 1.64 | 0.47 | | | | | | | | | | | |
| 165 | 0.336 | | | 0.336 | 0 | 0.055 | 0 | 1.58 | 3.77 | 1.58 | 0.462 | | | | | | | | | | | |
| 166 | 0.409 | | | 0.409 | 0 | 0.06 | 0 | 1.62 | 3.75 | 1.36 | 0.451 | | | | | | | | | | | |
| 167 | 0.371 | | | 0.371 | 0 | 0.06 | 0 | 2 | 3.73 | 1.51 | 0.457 | | | | | | | | | | | |
| 168 | 0.467 | | | 0.467 | 0 | 0.062 | 0 | 2.12 | 3.66 | 2 | 0.448 | | | | | | | | | | | |
| 169 | 0.36 | | | 0.36 | 0 | 1.12 | 0 | | 3.7 | 2.2 | 0 | | | | | | | | | | | |
| 170 | 0.401 | | | 0.401 | 0 | 0.062 | 0 | 2.56 | 3.67 | 1.69 | 0.45 | | | | | | | | | | | |
| 171 | 0.367 | | | 0.367 | 0 | 0.06 | 0 | 2.58 | 3.66 | 1.46 | 0.463 | | | | | | | | | | | |
| 172 | 0.403 | | | 0.403 | 0 | 0.145 | 0.066 | 2.84 | 3.03 | 1.93 | 0.016 | | | | | | | | | | | |
| 173 | 0.336 | | | 0.336 | 0.103 | 0.149 | 0.061 | 2.87 | 3.04 | 1.93 | 0.012 | | | | | | | | | | | |
| 174 | 0.24 | | | 0.24 | 0.085 | 0.16 | 0.091 | 2.98 | 2.92 | 1.97 | 0.017 | | | | | | | | | | | |
| 175 | 0.383 | | | 0.383 | 0.119 | 0.117 | 0.0327 | 2.98 | 3.35 | 1.92 | 0 | | | | | | | | | | | |
| 176 | 0.35 | | | 0.35 | 0.08 | 0.15 | 0.094 | 2.99 | 3.02 | 2.07 | 0.018 | | | | | | | | | | | |
| 177 | 0.32 | | | 0.32 | 0 | 0.21 | 0.12 | 3 | 2.81 | 2.1 | 0.08 | | | | | | | | | | | |
| 178 | 0.322 | | | 0.322 | 0 | 0.144 | 0.071 | 3.01 | 3.01 | 1.93 | 0.017 | | | | | | | | | | | |
| 179 | 0.32 | | | 0.32 | 0.13 | 0.17 | 0.07 | 3.04 | 3.13 | 1.9 | 0.03 | | | | | | | | | | | |
| 180 | 0.34 | | | 0.34 | 0 | 0.135 | 0.12 | | 3.1 | 1.99 | 0.016 | | | | | | | | | | | |
| 181 | 0.371 | | | 0.371 | 0 | 0.066 | 0 | 3.07 | 3.66 | 1.39 | 0.465 | | | | | | | | | | | |
| 182 | 0.402 | | | 0.402 | 0 | 0.166 | 0.085 | | 3.06 | 2.1 | 0.02 | | | | | | | | | | | |
| 183 | 0.384 | | | 0.384 | 0.088 | 0.158 | 0.074 | 3.08 | 3.08 | 2.13 | 0.016 | | | | | | | | | | | |
| 184 | 0.32 | | | 0.32 | 0.14 | 0.16 | 0.1 | 3.1 | 2.92 | 1.75 | 0.03 | | | | | | | | | | | |
| 185 | 0.384 | | | 0.384 | 0.104 | 0.168 | 0.079 | 3.11 | | 2.08 | 0.019 | | | | | | | | | | | |
| 186 | 0.392 | | | 0.392 | 0 | 0.07 | 0 | 3.19 | 3.67 | 1.5 | 0.459 | | | | | | | | | | | |
| 187 | 1.4 | | | 1.4 | 1.59 | 1.98 | 0 | | 0.25 | 0 | 3 | | | | | | | | | | | |
| 188 | 0.8 | | | 0.8 | 1.59 | 1.98 | 0 | | 0.25 | 0 | 2.4 | | | | | | | | | | | |
| 189 | | | | 0.49 | 0.01 | 0.3 | 1.3 | 6.5 | 2.6 | 0.31 | 3.2 | 0.24 | 0.00999 | | 0.00999 | 2.6 | 0.33 | | | | | |
| 190 | | | | 0.25 | 0.01 | 0.08 | 0.1 | 4 | 1 | 0 | 0.9 | 0 | 0 | | 0 | 1.5 | 0 | 0 | | | | |
| 191 | | | | 0.45 | 0.05 | 0.08 | 1 | 4 | 0.3 | 0 | 0.6 | 0 | 0 | | 0 | 1 | 0 | 0 | | | | |
| 192 | 0.32 | | | 0.32 | 0.1 | 0.17 | 0.1 | 0.017 | 3.1 | 1.7 | 0.03 | | | | | 0.01 | | 0.08 | | | | |
| 193 | 0.326 | | | 0.326 | 0 | 0.061 | 0 | 0.481 | 3.81 | 1.41 | 0.461 | | | | | 0 | | 0 | | | | |
| 194 | 0.464 | | | 0.464 | 0 | 0.055 | 0 | 0.516 | 3.89 | 1.67 | 0.452 | | | | | 0 | | 0 | | | | |
| 195 | 0.39 | | | 0.39 | 0.05 | 0.02 | 0.01 | 0.84 | 3.71 | 1.2 | 0.6 | | | | | 0.013 | | 0.01 | | | | |

TABLE 2-continued

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 196 | 0.299 | | | 0.299 | 0 | 0.051 | 0 | 0.95 | 3.77 | 1.31 | 0.452 | | | | | 0 | | 0 | | | | |
| 197 | 0.377 | | | 0.377 | 0 | 0.059 | 0 | 1.01 | 3.81 | 1.35 | 0.473 | | | | | 0 | | 0 | | | | |
| 198 | 0.336 | | | 0.336 | 0.04999 | 0.055 | 0.00999 | 1.58 | 3.77 | 1.58 | 0.462 | | | | | 0.00999 | | 0.0999 | | | | |
| 199 | 0.409 | | | 0.409 | 0.04999 | 0.06 | 0.00999 | 1.62 | 3.75 | 1.36 | 0.451 | | | | | 0.00999 | | 0.0999 | | | | |
| 200 | 0.31 | | | 0.31 | 0 | 0 | 0 | 1.85 | 3.7 | 2 | 0 | | | | | 0 | | 0 | | | | |
| 201 | 0.371 | | | 0.371 | 0 | 0.06 | 0 | 2 | | 1.51 | 0.457 | | | | | 0 | | 0 | | | | |
| 202 | 0.32 | | | 0.32 | 0 | 0.12 | 0.01 | 2.04 | 3.36 | 1.15 | 0.44 | | | | | 0.03 | | 0.01 | | | | |
| 203 | 0.467 | | | 0.467 | 0 | 0.062 | 0 | 2.12 | 3.66 | 2 | 0.448 | | | | | 0 | | 0 | | | | |
| 204 | 0.34 | | | 0.34 | 0 | 0.1 | 0 | 2.15 | 3.7 | 2 | 0 | | | | | 0 | | 0 | | | | |
| 205 | 0.401 | | | 0.401 | 0 | 0.062 | 0 | 2.56 | 3.67 | 1.69 | 0.45 | | | | | 0 | | 0 | | | | |
| 206 | 0.367 | | | 0.367 | 0 | 0.06 | 0 | 2.58 | 3.66 | 1.46 | 0.463 | | | | | 0 | | 0 | | | | |
| 207 | 0.403 | | | 0.403 | 0 | 0.145 | 0.066 | 2.84 | 3.03 | 1.93 | 0.016 | | | | | 0.01 | | 0.074 | | | | |
| 208 | 0.336 | | | 0.336 | 0.103 | 0.149 | 0.061 | 2.87 | 3.04 | 1.93 | 0.012 | | | | | 0.032 | | 0.072 | | | | |
| 209 | 0.24 | | | 0.24 | 0.085 | 0.16 | 0.091 | 2.98 | 2.92 | 1.97 | 0.017 | | | | | 0.028 | | 0.079 | | | | |
| 210 | 0.383 | | | 0.383 | 0.119 | 0.117 | 0.0327 | 2.98 | 3.35 | 1.92 | 0 | | | | | 0.0187 | | 0 | | | | |
| 211 | 0.35 | | | 0.35 | 0.08 | 0.15 | 0.094 | 2.99 | 3.02 | 2.07 | 0.018 | | | | | 0.029 | | 0.073 | | | | |
| 212 | 0.32 | | | 0.32 | 0 | 0.21 | 0.12 | 3 | 2.81 | 2.1 | 0.08 | | | | | 0.04 | | 0.1 | | | | |
| 213 | 0.322 | | | 0.322 | 0 | 0.144 | 0.071 | 3.01 | 3.01 | | 0.017 | | | | | 0.011 | | 0.08 | | | | |
| 214 | 0.32 | | | 0.32 | 0.13 | 0.17 | 0.07 | 3.04 | 3.13 | 1.9 | 0.03 | | | | | 0.03 | | 0.08 | | | | |
| 215 | 0.34 | | | 0.34 | 0 | 0.135 | 0.12 | 3.07 | 3.1 | 1.99 | 0.016 | | | | | 0.019 | | 0.069 | | | | |
| 216 | 0.371 | | | 0.371 | 0 | 0.066 | 0 | 3.07 | 3.66 | 1.39 | 0.465 | | | | | 0 | | 0 | | | | |
| 217 | 0.402 | | | 0.402 | 0 | 0.166 | 0.085 | 3.08 | 3.06 | 2.1 | 0.02 | | | | | 0.018 | | 0.018 | | | | |
| 218 | 0.384 | | | 0.384 | 0.088 | 0.158 | 0.074 | 3.08 | 3.08 | 2.13 | 0.016 | | | | | 0.019 | | 0.077 | | | | |
| 219 | 0.33 | | | 0.33 | 0.05 | 0.14 | 0.01 | 3.09 | 3.58 | 1.27 | 0 | | | | | 0.015 | | 0.02 | | | | |
| 220 | 0.32 | | | 0.32 | 0.14 | 0.16 | 0.1 | 3.1 | 2.92 | 1.75 | 0.03 | | | | | 0.02 | | 0.08 | | | | |
| 221 | 0.384 | | | 0.384 | 0.104 | 0.168 | 0.079 | 3.11 | 3.09 | 2.08 | 0.019 | | | | | 0.026 | | 0.079 | | | | |
| 222 | 0.392 | | | 0.392 | 0 | 0.07 | 0 | 3.19 | 3.67 | 1.5 | 0.459 | | | | | 0 | | 0 | | | | |
| 223 | 0.24 | | | 0.24 | 0.01 | 0.24 | 0.07 | 3.21 | 3.2 | 2.39 | 0.05 | | | | | 0.08 | | 0.19 | | | | |
| 224 | 0.392 | | | 0.392 | 0.0958 | 0.213 | 0.0832 | 3.73 | 3.63 | 2.52 | 0.0216 | | | | | 0.0182 | | 0.0845 | | | | |

For compositions 80, 105 to 110, 200, 210, 219 to 222, the elements As, Se, Sb, Te and Pb were measured to be 0.3% and the elements P and S were measured 0.7%

Example 5

Figure 5:
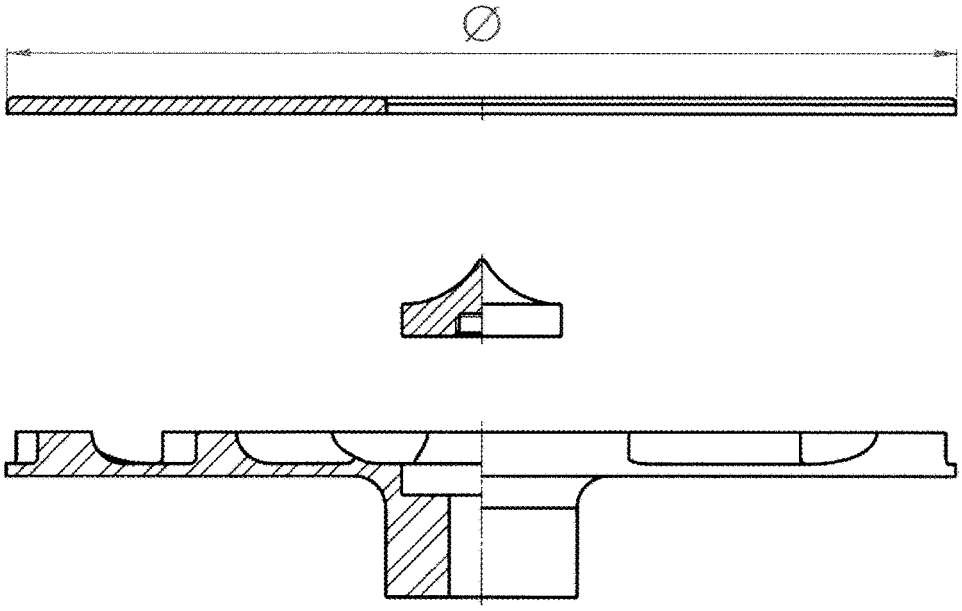
FIG. 5: Atomizing rotating element of the invention in a third embodiment.

The following Table 3 has been checked for the proper atomization of fine (<100 μm) spherical or quasi spherical powder (spheroidicity >92%) in a rotatory element according to FIG. 5, in an atmosphere of air. The following rules have been observed:

When % Cr>9.8 then % Ceq>0.14

When % Cr>9.8 then % Mo+% W+% V+% Ti>0.5 and/or % Si+% Al+% Ti+% Ni>0.5

TABLE 3

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 225 | 0.35 | | | 0.35 | | | 16.5 | 1 | 1.1 | | | | | | | | | | | | | |
| 226 | 0.68 | | | 0.68 | 1 | 1 | 17 | 0.6 | 0.75 | | | | | | | | | | | 0.03 | 0.04 | |
| 227 | 0.62 | | | 0.62 | 1 | 1 | 17 | 0.4 | 1 | | | | | | | | | | | 0.03 | 0.03 | |
| 228 | 0.9 | | | 0.9 | 1 | 1 | 18 | | 1.1 | | 0.1 | | | | | | | | | 0.02 | 0.02 | |
| 229 | 1.55 | | | 1.55 | 0.4 | 0.4 | 12 | | 0.9 | | 0.8 | | | | | | | | | | | |
| 230 | 0.05 | | | 0.05 | | | 16 | 4 | | | | | | | | | | 4 | | | | |
| 231 | 0.04 | | | 0.04 | | | 13 | 4 | 0.5 | | | | | | | | | | | | | |
| 232 | 0.4 | | | 0.4 | 0.35 | 0.9 | 16 | 0.6 | 1 | | | | | | | | | | | 0.001 | 0.01 | |
| 233 | 0.38 | | | 0.38 | 0.35 | 0.9 | 16 | 0.3 | | | | | | | | | | | | 0.07 | 0.01 | |
| 234 | 1.55 | | | 1.55 | 0.4 | 0.4 | 12 | | 0.7 | | 1 | | | | | | | | | | | |
| 235 | 1.55 | | | 1.55 | 0.4 | 0.4 | 12 | | 0.7 | | 1 | | | | | | | | | 0.03 | 0.03 | |
| 236 | 0.65 | | | 0.65 | 0.4 | 0.3 | 17 | | 2 | 0 | 0 | | | | | | | | | | | |

Example 6

The following Table 4 has been checked for the proper atomization of fine (<100 μm) spherical or quasi spherical powder in a rotatory element according to FIG. 4, in an atmosphere of N2. The following rules have been observed:

When % Co>0.9 then % V>1.2 and/or % Ni+% Al+% Ti+% Si>0.3 and/or Cr<0.8

TABLE 4

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 237 | 0.88 | | | 0.88 | 0 | 0 | 7.6 | 6 | 2.3 | | 2.5 | | | 0.005 | 1.6 | 0.3 | 0.01 | 0.01 | | | | |
| 238 | 0.33 | | | 0.33 | 0 | 0 | 8.3 | 6 | 1.4 | 0 | 0.6 | | | 0 | 1.6 | 0.86 | 0 | 0 | | | | |
| 239 | 0.4 | | | 0.4 | | | 7.5 | 9 | 1.3 | | 0.82 | | | | 1.6 | 1.5 | | | | | | |
| 240 | 1.55 | | | 1.55 | 0.38 | 0.32 | 4.04 | | 1 | 11.88 | 4.72 | | | | 4.8 | | | | | | | |
| 241 | 1.55 | | | 1.55 | 0.3 | 0.3 | 4.35 | | 1 | 12.5 | 5 | | | | 5.05 | | | | | | | |
| 242 | | | | 0.8 | 1.14 | 0.29 | 5.65 | 5.37 | 2.64 | 2.08 | 1.77 | 0 | 0 | | 3.48 | 2.17 | 0.6 | | | | | |
| 243 | | | | 0.56 | 0.1 | 0.15 | 2.44 | 8.32 | 1.8 | 2.7 | 1.31 | 0.54 | 0 | | 7.35 | 2.21 | 2.1 | | | | | |
| 244 | | | | 1 | 0.01 | 0.16 | 3.24 | 5.91 | 2.44 | 7.16 | 3.21 | 0 | 0 | | 7.05 | 1.38 | 1.9 | | | | | |
| 245 | | | | 0.36 | 1 | 0.4 | 5 | 5 | 1 | 0 | 0.85 | 0 | 0 | | 1.5 | 0.8 | 0.1 | | | | | |
| 246 | | | | 2.3 | 0.03 | 0.28 | 2.48 | 6.1 | 3.14 | 7.85 | 8.01 | 0 | 0.04 | | 7.25 | 1.4 | 1.98 | | | | | |
| 247 | | | | 0.52 | 0.06 | 0.29 | 2.64 | 5.97 | 1.86 | 0.08 | 2.08 | 0 | 0 | | 1.64 | 1.52 | 1.22 | | | | | |
| 248 | | | | 0.45 | 0.01 | 0.2 | 2 | 6 | 1 | 0.5 | 1 | 0 | 0 | 0 | 1 | 1.5 | 0.2 | 0 | 0 | | | |
| 249 | | | | 0.6 | 1.4 | 3 | 8 | 12 | 3 | 2 | 3.5 | 1 | 1 | 1 | 6 | 4 | 2 | 2 | 1 | | | |
| 250 | | | | 0.43 | 1 | 3 | 8 | 12 | 10 | 15 | 2 | 2 | 2 | | 10 | 3 | 3 | 4 | | | | |
| 251 | | | | 0.8 | 1 | 3 | 4 | 12 | 5 | 1 | 2 | | 2 | 1 | 14 | 5 | 3 | 2 | 1 | | | |
| 252 | | | | 2.5 | 1 | 3 | 8 | 8 | 10 | 15 | 12 | 2 | 2 | | 14 | 3 | 3 | 4 | | | | |
| 253 | | | | 1.2 | 1.5 | 3 | 8 | 10 | 5 | 5 | 4 | 2 | 2 | | 8 | 3 | 3 | 4 | | | | |
| 254 | | | | 0.45 | 0.01 | 0.08 | 0.1 | 6 | 1 | 0 | 0.6 | | 0.2 | 0 | 1.5 | 1.5 | 0.5 | 0 | 0 | | | |
| 255 | 0.41 | | | 0.41 | 0.04 | 0.02 | 0.01 | | 3.63 | 1.63 | 0.81 | | | | 3 | | | | | | | |
| 256 | | | | 0.54 | 0.12 | 0.38 | 1.96 | 7.2 | 2.03 | 2.13 | 1.51 | 0.02 | 0.02 | | 2.18 | 1.86 | 2.06 | | | | | |
| 257 | | | | 0.51 | 0.03 | 0.16 | 0.15 | 7.93 | 2.85 | 0 | 2.85 | 0.53 | 0 | | 1.75 | 2.1 | 0.8 | | | | | |
| 258 | | | | 0.45 | 0.24 | 1.89 | 1.8 | 7.42 | 2.2 | 0 | 2.5 | 0 | 0 | | 1.79 | 2.15 | 0.5 | | | | | |
| 259 | | | | 0.48 | 0.25 | 0.08 | 1.49 | 11.94 | 3.05 | 3.42 | 1.61 | 0 | 0 | | 9.74 | 4.5 | 1.2 | | | | | |
| 260 | 0.005 | | | 0.005 | | | | 17.5 | 3.75 | | | | | | 12.5 | 0.15 | 1.85 | | | | | |
| 261 | 0.45 | | | 0.45 | 0 | 0 | 1.4 | 9.22 | 5.3 | 1 | | | | | 1.5 | 1.8 | 0 | 0 | | | | |
| 262 | 0.46 | | | 0.46 | 0 | 0 | 0 | 9.22 | 4.1 | 1.01 | 0 | | | 0 | 1.5 | 1.81 | 0 | 0 | | | | |
| 263 | 0.34 | | | 0.34 | | | 1.4 | 9.22 | 4.5 | 1 | | | | | 1.5 | 1.8 | | | | | | |
| 264 | 0.29 | | | 0.29 | 0.15 | 0.32 | 0.02 | | 3.3 | 0.76 | 0.5 | 0.11 | 0.14 | | 2.8 | | | | | | | 0.001 |
| 265 | 0.32 | | | 0.32 | | 0 | | | 3.36 | 1.52 | 0.45 | | | | 2.66 | | | | | | | |
| 266 | 0.36 | | | 0.36 | 0.2 | 0.47 | | | 3.75 | 1.91 | 0.44 | 0.2 | 0.2 | | 2.44 | | | | | | | |
| 267 | 0.34 | | | 0.34 | | 0.6 | | | 4.04 | 1.23 | 0.73 | | | | 2.16 | | | | | | | |
| 268 | 0.37 | | | 0.37 | | 0 | | 2.7 | 3.64 | 1.21 | 0.49 | 2.7 | 2.7 | | 1.6 | | | | | | | |
| 269 | 0.51 | | | 0.51 | | 0 | | 2.9 | 3.75 | 1.51 | 0 | 2.9 | 2.9 | | 2.1 | | | | | | | |
| 270 | 0.36 | | | 0.36 | | 0.58 | | | 3.28 | 0.91 | 0.55 | | | | 3.1 | | | | | | | |
| 271 | 0.61 | | | 0.61 | | 0.54 | | | 3.6 | 1.19 | 0.56 | | | | 2.6 | | | | | | | |
| 272 | 0.43 | | | 0.43 | | 0.5 | | | 3.22 | 0.96 | 0.04 | | | | 2.8 | | | | | | | |
| 273 | 0.32 | | | 0.32 | | 0.41 | | | 3.25 | 0.96 | 0.43 | | | | 2.45 | | | | | | | |
| 274 | 0.33 | | | 0.33 | | 0.16 | | | 3.48 | 0.86 | 0 | | | | 2.49 | | | | | | | |
| 275 | 0.29 | | | 0.29 | | 0.32 | 0.02 | | 3.3 | 0.76 | 0.5 | | | 0.005 | 2.8 | | 0.01 | 0.01 | | | | |
| 276 | 0.44 | | | 0.44 | 0.05 | 0.02 | 0.01 | | 3.64 | 1.97 | 0.7 | | | | 3 | | | | | | | |
| 277 | 0.43 | | | 0.43 | 0.05 | 0.02 | 0.01 | | 3.73 | 1.8 | 0.69 | | | | 3 | | | | | | | |

For compositions 257, 261 and 270, the elements H, He, Be, O, F, Ne, Mg, Cl, Ar, K, Ca, Sc, Zn, Ga, Ge, As, Se, Br, Kr, Rb, Sr, Y, Tc, Ru, Rh, Pd, Ag, Cd, In, Sn, Sb, Te, I, Xe, Cs, Ba, La, Ce, Pr, Nd, Pm, Sm, Eu, Gd, Tb, Dy, Ho, Er, Tm, Yb, Lu, Re, Os, Ir, Pt, Au, Hg, Tl, Pb, Bi, Po, At, Rn, Fr, Ra, Ac, Th, Pa, U, Np, Pu, Am, Cm, Bk, Cf, Es, Fm, Md, No, Lr, Rf, Db, Sg, Bh, Hs, Mt are <0.01% (otherwise indicated in the table).

Example 7

Figure 6:
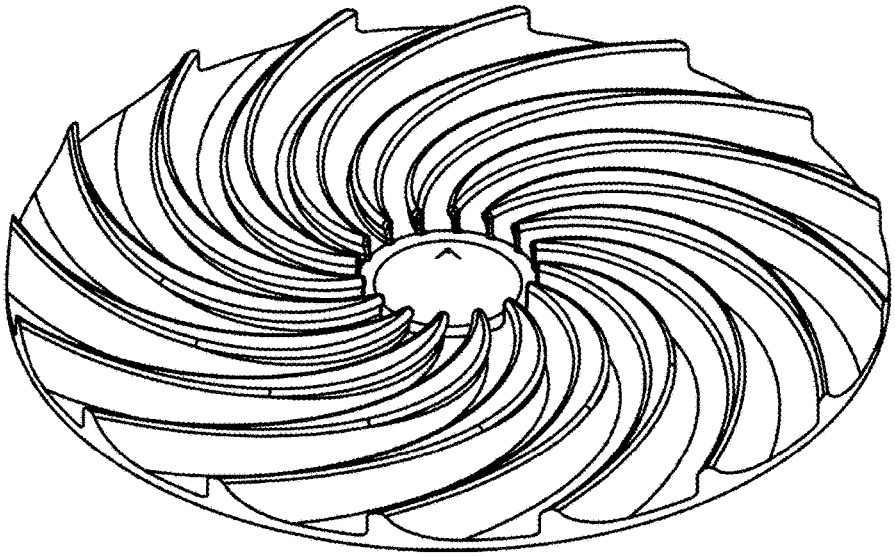
FIG. 6: Atomizing rotating element of the invention in a fourth embodiment.

The following Table 5 has been checked for the proper atomization of fine (<100 μm) spherical or quasi spherical powder (spheroidicity >85%) in a rotatory element according to FIG. 6, in a mixed atmosphere with lack of O2.

TABLE 5

| | % C | % N | % B | % Ceq | % Si | % Mn | % Cr | % Ni | % Mo | % W | % V | % Zr | % Hf | % Nb | % Co | % Al | % Ti | % Cu | % Ta | % S | % P | % O |
|---|---|---|---|---|---|---|---|---|---|---|---|---|---|---|---|---|---|---|---|---|---|---|
| 278 | 1.2 | | | 1.2 | 0.3 | 25 | 4 | 5 | | | 3.8 | | | | 1.5 | 1.1 | | 4 | | | | |
| 279 | 0.05 | | | 0.05 | 0.18 | 0.29 | 18.1 | 52.3 | 2.99 | | | | | 5.26 | 0.25 | 0.55 | 1.1 | 0.03 | | | | |
| 280 | 1.1 | | | 1.1 | | | 26 | | | 5 | | | | | 68 | | | | | | | |
| 281 | 0.08 | | | 0.08 | | | | | | | | | | | | | 99.2 | | | | | |
| 282 | 0.08 | | | 0.08 | | | | | | | 4 | | | | | 6 | 89.9 | | | | | |
| 283 | 0.02 | | | 0.02 | 0.008 | | | 0.002 | 99.2 | | | | | | | | 0.5 | | | | | |
| 284 | 0.02 | | | 0.02 | 0.008 | | | 0.002 | 99.2 | | | | | | | | 0.5 | | | | | |
| 285 | | | | 0 | | | | | | 75 | | | | | | | | 25 | | | | |
| 286 | | | | 0 | | | | 6 | | 90 | | | | | | | | 4 | | | | |
| 287 | | | | 0 | | | | | | 99.95 | | | | | | | | | | | | |
| 288 | 1.21 | | | 1.21 | | 25.04 | 4.23 | 5.9 | | | 3.45 | | | | 1.62 | 1.21 | | 4.18 | | | | |

The invention claimed is:

1. A method for producing alloy powders or particulate material, comprising the steps of:

(a) providing an alloy composition with a melting point above 1040° C., wherein the alloy composition is chosen from alloy compositions within the following chemical composition ranges (wt. %):

| | | | |
|---|---|---|---|
| % Ceq = 0.001-2.8 | % C = 0.001-2.8 | % N = 0.0-2.0 | % B = 0.0-2 |
| % Cr = 0.0-20.0 | % Ni = 0.0-25.0 | % Si = 0.0-3.0 | % Mn = 0.0-7.0 |
| % Al = 0.0-6.0 | % Mo = 0.0-11.0 | % W = 0.0-16.0 | % Ti = 0.0-3.0 |
| % Ta = 0.0-2.0 | % Zr = 0.0-10.0 | % Hf = 0.0-4.0 | % V = 0.0-15.0 |
| % Nb = 0.0-4.0 | % Cu = 0.0-5.0 | % Co = 0.0-15.0 | % Ce = 0.0-2 |
| % Ca = 0.0-1 | % P = 0.0-2 | % S = 0.0-2 | % As = 0.0-2 |
| % Bi = 0.0-1 | % Pb = 0.0-2 | % Sb = 0.0-1 | % Li = 0.0-1 |
| % Te = 0.0-2 | % Zn = 0.0-1 | % Cd = 0.0-1 | % Sr = 0.0-1 |
| % K = 0.0-1 | % Na = 0.0-1 | | |

the rest consisting of iron and trace elements;

wherein % Ceq=% C+0.86·% N+1.2·% B and wherein:

when % Co>0.9 then % V>1.2 and/or % Ni+% Al+% Ti+% Si>0.3 and/or Cr<0.8 when % Cr>9.8 then % Ceq>0.14 and when % Cr>9.8 then % Mo+% W+% V+% Ti>0.5 and/or % Si+% Al+% Ti+% Ni>0.5 when % Cr<2 then % Mo+% W+% V+% Ti>0.5, (b) melting the composition, and (c) atomizing the molten composition by means of centrifugal atomization or rotating atomization with a rotating atomization device having an atomizing rotating element and a nozzle, the rotating element presenting a plurality of protuberances with a radial component, a number and configuration of the protuberances being effective to allow distribution and flow of the molten composition in a normal direction to a surface of a base of the rotating element so as to enable atomization of the molten composition when exiting the nozzle at a feed rate of 55 $kg \cdot h^{-1}$ or more, the atomizing being carried out with the molten composition exiting the nozzle at the feed rate of 55 $kg \cdot h^{-1}$ or more.

2. The method according to claim 1, wherein the rotating element presents protuberances with a profile evolution in the direction normal to the active surface of the rotating element at the line of insertion.

3. The method according to claim 1, wherein the rotating element presents protuberances with a variable curvature in the direction normal to the active surface of the rotating element at the line of insertion.

4. The method according claim 1, wherein the rotating element presents protuberances with a variable curvature in the direction parallel to the active surface of the rotating element at the line of insertion.

5. The method according to claim 1, wherein the protuberances form vanes on the surface of the atomizing rotating element, wherein the vanes have a profile that is contained in a single plane.

6. The method according to claim 1, wherein the profile of the vanes is determined using analytical mathematical models that predict radial and tangential velocities of the liquid metal as functions of the radius of the rotating element, the liquid kinematic viscosity, the volume flow rate, the metallostatic head, and the rotational speed.

7. The method according to claim 1, wherein the active surface of the atomizing rotating element in contact with the molten metal is made and/or coated with materials from the group consisting of fused silicon, graphite, fully stabilized zirconia (FSZ), partially stabilized zirconia (PSZ), silicon carbide, silicon nitride, zircon, alumina, magnesia, AlN, BN, $MgZrO_3$, SiAlON, $AlTiO_3$, $ZrO_2$, SiC, $MgZrO_3$, CaO, and $ZrO_2$.

8. The method according to claim 1, wherein the material of the atomizing rotating element exhibits a yield strength higher than 460 MPa.

9. The method according to claim 1, wherein the material of the atomizing rotating element exhibits a melting temperature higher than 1400° C., a mechanical strength higher than 680 MPa and is coated with a material that promotes a wettability lower than 90° with the alloy that is intended to be atomized.

10. The method according to claim 1, wherein the geometry of the atomizing rotating element allows the distribution and the flow of the liquid metal in a normal direction to the surface of the base of the rotating element.

11. A steel powder with the following composition, all ranges in wt. %:

| | | | |
|---|---|---|---|
| | % C = 0.001-2.8 | % N = 0.0-2.0 | % B = 0.0-2 |
| % Cr = 0.0-20.0 | % Ni = 0.0-25.0 | % Si = 0.0-3.0 | % Mn = 0.0-7.0 |
| % Al = 0.0-6.0 | % Mo = 0.0-11.0 | % W = 0.0-16.0 | % Ti = 0.0-3.0 |
| % Ta = 0.0-2.0 | % Zr = 0.0-10.0 | % Hf = 0.0-4.0 | % V = 0.0-15.0 |
| % Nb = 0.0-4.0 | % Cu = 0.0-5.0 | % Co = 0.0-15.0 | % Ce = 0.0-2 |
| % Ca = 0.0-1 | % P = 0.0-2 | % S = 0.0-2 | % As = 0.0-2 |
| % Bi = 0.0-1 | % Pb = 0.0-2 | % Sb = 0.0-1 | % Li = 0.0-1 |
| % Te = 0.0-2 | % Zn = 0.0-1 | % Cd = 0.0-1 | % Sr = 0.0-1 |
| % K = 0.0-1 | % Na = 0.0-1 | | |

the rest consisting of iron and trace elements;

wherein % Ceq=% C+0.86·% N+1.2·% B and % Ceq is higher than 0.62% and not more than 2.8%;

wherein:

when % Co>0.9 then % V>1.2 and/or % Ni+% Al+% Ti+% Si>0.3 and/or Cr<0.8 when % Cr>9.8 then % Ceq>0.14 and when % Cr>9.8 then % Mo+% W+% V+% Ti>0.5 and/or % Si+% Al+% Ti+% Ni>0.5 when % Cr<2 then % Mo+% W+% V+% Ti>0.5; and wherein the steel powder is prepared by centrifugal atomization such that the steel powder has a sphericity of greater than 0.76.

12. The steel powder according to claim 11, wherein when % C≥2 or % Cr≤10, then % Cr+% Ti+% W+% Mo+% V+% Nb+% Zr+% Hf+% Co≥0.5.

13. The steel powder according to claim 11, wherein % C<0.1, with the proviso that when % Ni≥0.9 and % Co≥0.9, then % Si<0.4.

14. A steel powder with the following composition, all ranges in wt. %:

| | | | |
|---|---|---|---|
| % Ceq = 0.001-2.8 | % C = 0.001-2.8 | % N = 0.0-2.0 | % B = 0.0-2 |
| % Cr = 0.0-20.0 | % Ni = 0.0-25.0 | % Si = 0.0-3.0 | % Mn = 0.0-7.0 |
| % Al = 0.0-6.0 | % Mo = 0.0-11.0 | % W = 0.0-16.0 | % Ti = 0.0-3.0 |
| % Ta = 0.0-2.0 | % Zr = 0.0-10.0 | % Hf = 0.0-4.0 | % V = 0.0-15.0 |
| % Nb = 0.0-4.0 | % Cu = 0.0-5.0 | % Co = 0.0-15.0 | % Ce = 0.0-2 |
| % Ca = 0.0-1 | % P = 0.0-2 | % S = 0.0-2 | % As = 0.0-2 |
| % Bi = 0.0-1 | % Pb = 0.0-2 | % Sb = 0.0-1 | % Li = 0.0-1 |
| % Te = 0.0-2 | % Zn = 0.0-1 | % Cd = 0.0-1 | % Sr = 0.0-1 |
| % K = 0.0-1 | % Na = 0.0-1 | | |

the rest consisting of iron and trace elements;

wherein % Ceq=% C+0.86·% N+1.2·% B;

wherein:

when % Co>0.9 then % V>1.2 and/or % Ni+% Al+% Ti+% Si>0.3 and/or Cr<0.8 when % Cr>9.8 then % Ceq>0.14 and when % Cr>9.8 then % Mo+% W+% V+% Ti>0.5 and/or % Si+% Al+% Ti+% Ni>0.5 when % Cr<2 then % Mo+% W+% V+% Ti>0.5; and wherein the steel powder is prepared by centrifugal atomization such that the steel powder has a sphericity of at least 0.92.

* * * * *